US009915122B2

(12) United States Patent
Hofman et al.

(10) Patent No.: US 9,915,122 B2
(45) Date of Patent: Mar. 13, 2018

(54) DOWNHOLE TOOLS, SYSTEM AND METHODS OF USING

(71) Applicant: Peak Completion Technologies, Inc., Midland, TX (US)

(72) Inventors: Raymond Hofman, Midland, TX (US); William Sloane Muscroft, Midland, TX (US)

(73) Assignee: Peak Completion Technologies, Inc., Midland, TX (US)

( * ) Notice: Subject to any disclaimer, the term of this patent is extended or adjusted under 35 U.S.C. 154(b) by 338 days.

(21) Appl. No.: 14/504,688

(22) Filed: Oct. 2, 2014

(65) Prior Publication Data

US 2015/0129205 A1 May 14, 2015

Related U.S. Application Data

(63) Continuation-in-part of application No. 14/211,122, filed on Mar. 14, 2014, now Pat. No. 9,567,832, and a continuation-in-part of application No. 13/462,810, filed on May 2, 2012, now Pat. No. 9,133,684.

(60) Provisional application No. 61/885,615, filed on Oct. 2, 2013, provisional application No. 61/801,937, filed on Mar. 15, 2013, provisional application No. 61/862,766, filed on Aug. 6, 2013, provisional application No. 61/481,483, filed on May 2, 2011.

(51) Int. Cl.

| | |
|---|---|
| ***E21B 33/13*** | (2006.01) |
| ***E21B 34/06*** | (2006.01) |
| ***E21B 34/10*** | (2006.01) |
| *E21B 34/00* | (2006.01) |

(52) U.S. Cl.

CPC ..... *E21B 33/13* (2013.01); *E21B 34/063* (2013.01); *E21B 34/103* (2013.01); *E21B 2034/007* (2013.01)

(58) Field of Classification Search

CPC .. E21B 2034/007; E21B 33/13; E21B 34/063; E21B 34/08; E21B 34/103; E21B 34/14; E21B 47/0006

See application file for complete search history.

(56) References Cited

U.S. PATENT DOCUMENTS

2009/0014168 A1* 1/2009 Tips ..... E21B 33/14 166/73
2009/0283271 A1* 11/2009 Langeslag ..... E21B 34/063 166/297

(Continued)

*Primary Examiner* — Caroline N Butcher

(57) ABSTRACT

Downhole tools, including downhole valves, may actuate via a pressure differential created across a shifting element having one or more pressure surfaces isolated from fluid, and fluid pressure, flowing through the interior flowpath. Embodiment downhole tools of the present disclosure may actuate in response to, among other signals, fluid pressure in the interior flowpath of the tool and fluid pressure communicated to a pressure surface of the shifting sleeve from the exterior of the tool. Certain embodiments may also have an outlet connector whereby fluid pressure from the downhole tool may be communicated to its exterior. Isolation of the shifting element from the interior flowpath may be accomplished using a frangible, shiftable, degradable or other members which may be moved from a closed state to an open state in response to fluid conditions in the interior flowpath.

16 Claims, 24 Drawing Sheets

(56) References Cited

U.S. PATENT DOCUMENTS

| | | | | |
|---|---|---|---|---|
| 2011/0108272 | A1* | 5/2011 | Watson | E21B 34/103<br>166/271 |
| 2012/0111574 | A1* | 5/2012 | Desranleau | E21B 34/14<br>166/373 |
| 2014/0246209 | A1* | 9/2014 | Themig | E21B 43/14<br>166/374 |
| 2014/0338923 | A1* | 11/2014 | Fripp | E21B 34/063<br>166/376 |

* cited by examiner

DOWNHOLE TOOLS, SYSTEM AND METHODS OF USING

CROSS-REFERENCES TO RELATED APPLICATIONS

This non-provisional application claims the benefit of U.S. Provisional Patent Application Ser. No. 61/885,615; is a Continuation in Part, and claims the benefit, of U.S. patent application Ser. No. 14/211,122, entitled Downhole Tools System and Method of Using filed Mar. 14, 2014, which claims the benefit of U.S. Provisional Patent Application Ser. No. 61/801,937, entitled "Downhole Tools System and Method of Using" filed on Mar. 15, 2013; and of U.S. Provisional Patent Application Ser. No. 61/862,766, entitled "Downhole Tools System and Method of Using" filed on Aug. 16, 2013; and is a Continuation in Part of U.S. patent application Ser. No. 13/462,810, filed May 2, 2012 entitled "Downhole Tool," which claims the benefit of U.S. Provisional Patent Application Ser. No. 61/481,483 filed on May 2, 2011. Each of the foregoing references are incorporated herein by reference in their entirety.

STATEMENT REGARDING FEDERALLY SPONSORED RESEARCH OR DEVELOPMENT

Not applicable.

BACKGROUND

1. Field

The described embodiments and invention as claimed relate to oil and natural gas production. More specifically, the embodiments described herein relate to downhole tools systems and methods used to selectively pressurize and test a production string or casing and to selectively activate a tool or a series of tools connected together by flow lines.

2. Description of the Related Art

In completion of oil and gas wells, tubing is often inserted into the well to function as a flow path for treating fluids into the well and for production of hydrocarbons from the well. Such tubing may help preserve casing integrity, optimize production, or serve other purposes. Such tubing may be described or labeled as casing, production tubing, liners, tubulars, or other terms. The term "tubing" as used in this disclosure and the claims is not limited to any particular type, shape, size or installation of tubular goods.

To fulfill these purposes, the tubing must maintain structural integrity against the pressures and pressure cycles it will encounter during its functional life. To test this integrity, operators will install the tubing with a closed "toe"—the end of the tubing furthest from the wellhead—and then subject the tubing to a series of pressure tests. These tests are designed to demonstrate whether the tubing will hold the pressures for which it was designed, to which it will be subjected during operation or an acceptable alternative pressure, depending on the particular circumstances.

One detriment to these pressure tests is the necessity for a closed toe. After pressure testing, the toe must be opened to allow for free flow of fluids through the tubing so that further operations may take place. While formation characteristics, cement, or other factors may still restrict fluid flow, the presence of such factors do not alleviate the desirability or necessity for opening the toe of the tubing. Commonly, the toe is opened by positioning a perforating device in the toe and either explosively or abrasively perforating the tubing to create one or more openings. Perforating, however, requires additional time and equipment that increase the cost of the well. Therefore, there exists a need for an improved method to economically pressure test the tubing and open the toe of the tubing after it is installed and pressure tested.

The present disclosure describes an improved device and method for pressure testing the tubing and opening the toe of tubing installed in a well. The device and method may be readily adapted to other well applications as well. The present disclosure also describes embodiments having degradable or shiftable triggering devise as well as embodiments relating to actuating a series of tools using flow lines that communicate fluid pressure between connected tools for actuation.

SUMMARY OF CERTAIN EMBODIMENTS

The described embodiments of the present disclosure address the problems associated with the closed toe required for pressure testing tubing installed in a well. Further, in one aspect of the present disclosure, a chamber, such as a pressure chamber, air chamber, or atmospheric chamber, is in fluid communication with at least one surface of the shifting element, which may be a shifting sleeve, of the device. The chamber is isolated from the interior of the tubing such that fluid pressure inside the tubing is not transferred to the chamber. A second surface of the shifting sleeve is in fluid communication with the interior of the tubing. Application of fluid pressure on the interior of the tubing thereby creates a pressure differential across the shifting element, applying force tending to shift the shifting element in the direction of the pressure chamber, atmospheric chamber, or air chamber.

In a further aspect of the present disclosure, the shifting sleeve is encased in an enclosure such that all surfaces of the shifting element opposing the chamber are isolated from the fluid, and fluid pressure, in the interior of the tubing. Upon occurrence of some predetermined event—such as a minimum fluid pressure, the presence of acid, or electromagnetic signal—at least one surface of the shifting element is exposed to the fluid pressure from the interior of the tubing, creating differential pressure across the shifting sleeve. Specifically, the pressure differential is created relative to the pressure in the chamber, and applies a force on the shifting element in a desired direction. Such force activates the tool.

While specific predetermined events are stated above, any event or signal communicable to the device may be used to expose at least one surface of the shifting element to pressure from the interior of the tubing.

In a further aspect, the downhole tool comprises an inner sleeve with a plurality of sleeve ports. A housing is positioned radially outwardly of the inner sleeve, with the housing and inner sleeve partially defining a space radially therebetween. The space, which is preferably annular, is occupied by a shifting element, which may be a shifting sleeve. A fluid path extends between the interior flowpath of the tool and the space. Thus, the shifting element may be nested between the housing and the inner sleeve. A fluid control device, which is preferably a burst disk, occupies at least portion of the fluid path.

When the toe is closed, the shifting sleeve is in a first position between the housing ports and the sleeve ports to prevent fluid flow between the interior flowpath and exterior of the tool. A control member is installed to prevent or limit movement of the shifting sleeve until a predetermined internal tubing pressure or internal flowpath pressure is reached. Such member may be a fluid control device which selectively permits fluid flow, and thus pressure communication, into the annular space to cause a differential pressure across the shifting sleeve. Any device, including, without limitation, shear pins, springs, and seals, may be used provided such device allows movement of the shifting element, such as shifting sleeve, only after a predetermined internal tubing pressure or other predetermined event occurs. In a preferred embodiment, the fluid control device will permit fluid flow into the annular space only after it is exposed to a predetermined differential pressure. When this differential pressure is reached, the fluid control device allows fluid flow, the shifting sleeve is moved to a second position, the toe is opened, and communication may occur through the housing and sleeve ports between the interior flowpath and exterior of the tool.

In a further aspect of this disclosure, embodiments of the downhole tool may be connected in series with one or more other tools to enable fluid pressure and fluid flow at one location in a tool string to actuate another tool in the series. Such embodiments may include a plurality of similar tools such that actuation of one tool also actuates other tools in the series. Such embodiments may include flow lines, separate tubing, annular spaces (such as between tools and casing, housing and inner sleeve or mandrel, through a wall of a housing, inner sleeve or mandrel, or otherwise), other fluid path defining means, or combinations of the above, to transfer fluid pressure from the interior of one tool to pressure chambers within separate tools, thereby creating pressure differentials to effect hydraulic actuation of the separate tools. The first tool in such series may be referred to as an initiator tool while the last tool may be referred to as a terminator tool. Tools in such a series between the initiator and the terminator may be called intermediate tools. Such intermediate tools can receive fluid communication from a preceding tool along a fluid conduit distinct from the internal flowpath of the tubing string and transmit fluid flow and/or pressure with a subsequent tool along a fluid conduit also distinct from the internal flowpath of the tubing string. Some embodiments of such intermediate tools may actuate in response to the fluid communication received from the preceding tool. Further, some embodiments of tools according to the present disclosure are ported valves, having ports allowing fluid communication between the interior and the exterior of the tool following actuation, while other embodiments are portless and do not allow such fluid communication.

DETAILED DESCRIPTION OF CERTAIN EMBODIMENTS

When used with reference to the figures, unless otherwise specified, the terms "upwell," "above," "top," "upper," "downwell," "below," "bottom," "lower," and like terms are used relative to the direction of normal production and/or flow of fluids and or gas through the tool and wellbore. Thus, normal production results in migration through the wellbore and production string from the downwell to upwell direction without regard to whether the tubing string is disposed in a vertical wellbore, a horizontal wellbore, or some combination of both. Similarly, during the fracing process, fracing fluids and/or gasses move from the surface in the downwell direction to the portion of the tubing string within the formation. Further, the directional description of a part or component of a tool, such as "top" or "bottom" connection refers only to a preferred embodiment thereof and does not limit the orientation of the tool as installed in a wellbore except as may be otherwise required by the language of the claims.

Figure 1:
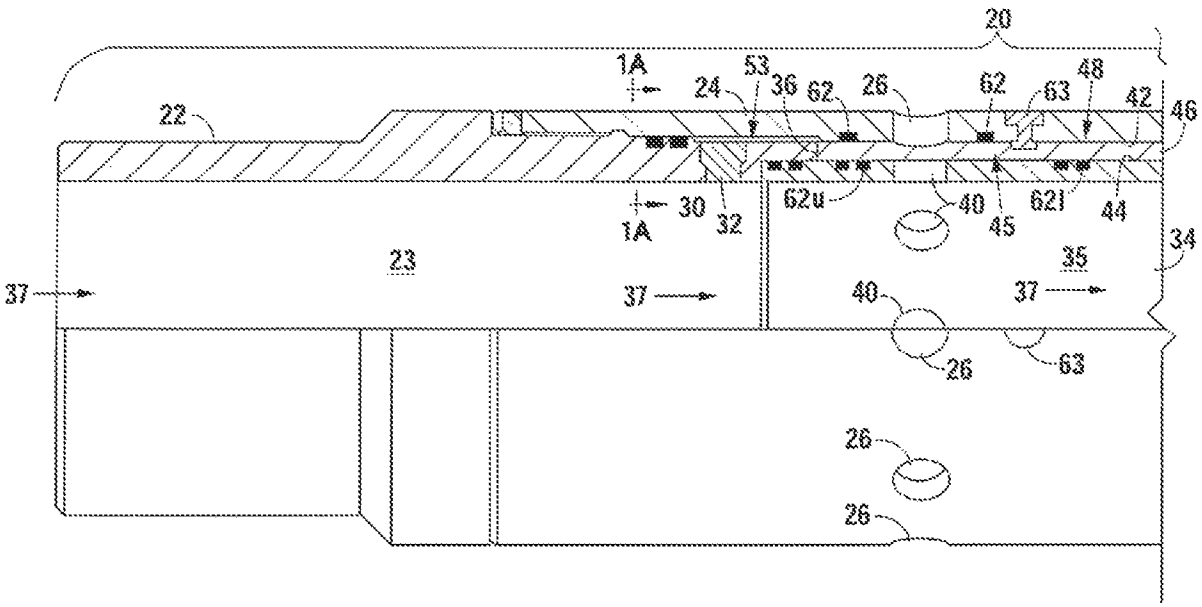
FIGS. 1-2 are partial sectional side elevations of a preferred embodiment in the closed position.
Figure 1A:
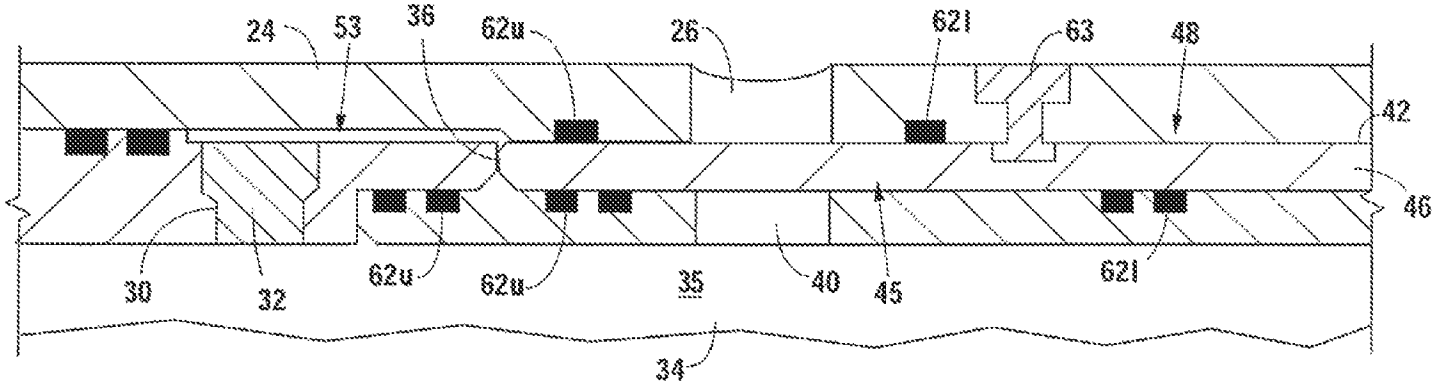
FIGS. 1A & 2A are enlarged views of windows 1A and 2A of FIGS. 1 & 2 respectively.
Figure 2:
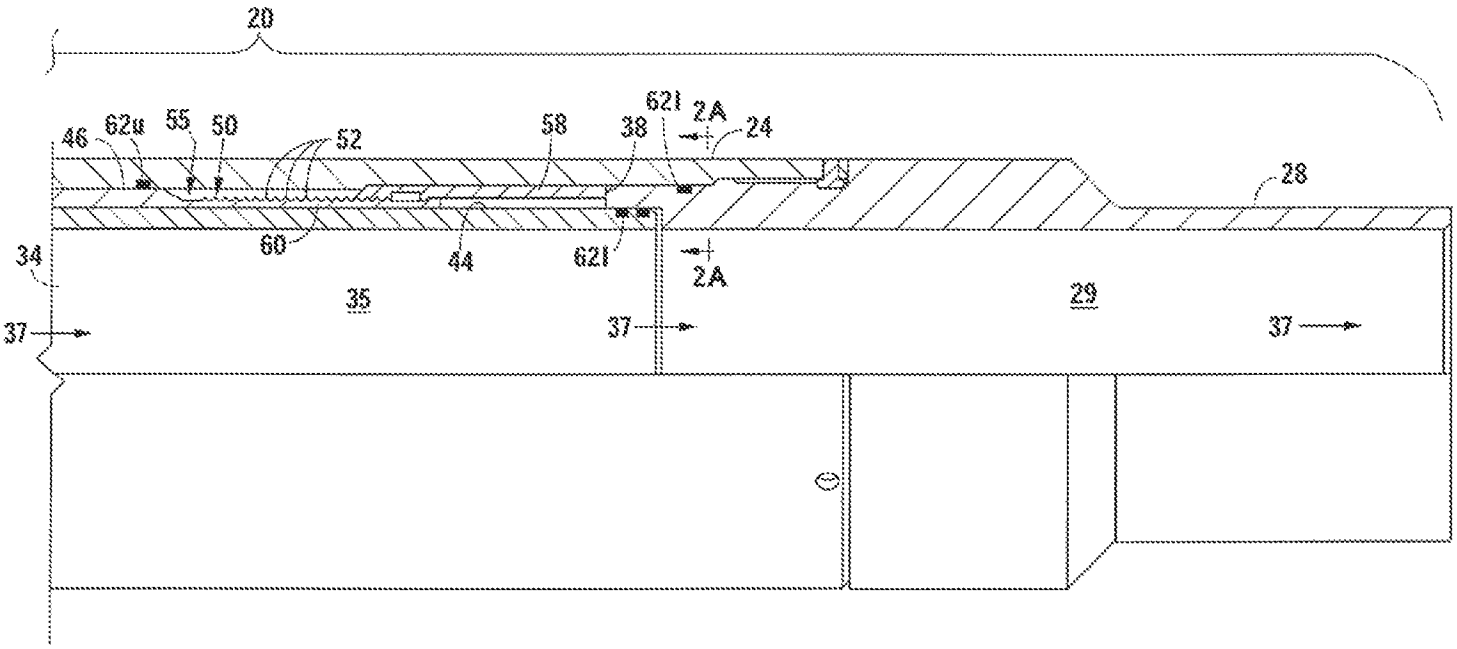
Figure 2A:
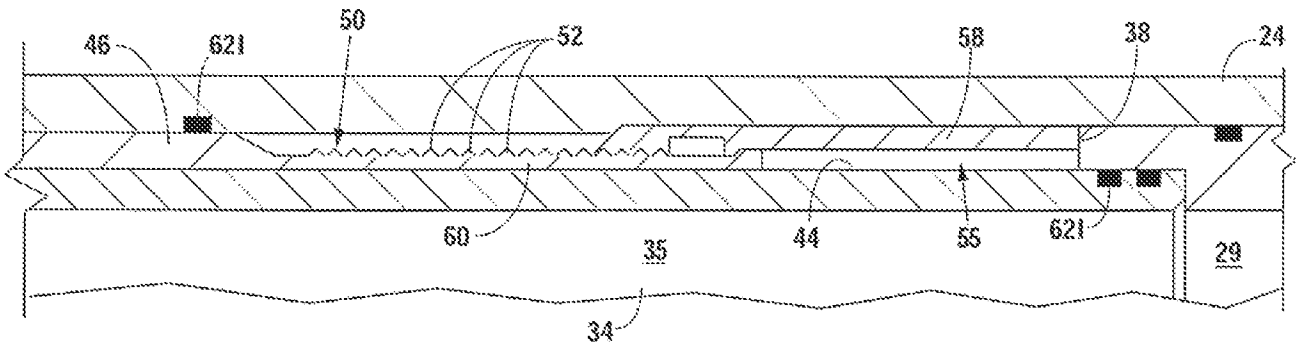

FIGS. 1-2 depict a preferred embodiment 20, which comprises a top connection 22 threaded to a top end of ported housing 24 having a plurality of radially-aligned housing ports 26. A bottom connection 28 is threaded to the bottom end of the ported housing 24. The top and bottom connections 22, 28 have cylindrical inner surfaces 23, 29, respectively. A fluid path 30 through the wall of the top connection 22 is filled with a burst disk 32 that will rupture when a pressure is applied to the interior of the tool 22 that exceeds a rated pressure.

An inner sleeve 34 having a cylindrical inner surface 35 is positioned between a lower annular surface 36 of the top connection 22 and an upper annular surface 38 of the bottom connection 28. The inner sleeve 34 has a plurality of radially aligned sleeve ports 40. Each of the sleeve ports 40 is concentrically aligned with a corresponding housing port 26. The inner surfaces 23, 29 of the top and bottom connections 22, 28 and the inner surface 35 of the sleeve 35 define an interior flowpath 37 for the movement of fluids into, out of, and through the tool. In an alternative embodiment, the interior flowpath may be defined, in whole or in part, by the inner surface of the shifting sleeve.

Although the housing ports 26 and sleeve ports 40 are shown as cylindrical channels between the exterior and interior of the tool 20, the ports 26, 40 may be of any shape sufficient to facilitate the flow of fluid therethrough for the specific application of the tool. For example, larger ports may be used to increase flow volumes, while smaller ports may be used to reduce cement contact in cemented applications. Moreover, while preferably concentrically aligned, each of the sleeve ports 40 need not be concentrically aligned with its corresponding housing port 26.

The top connection 22, the bottom connection 28, an interior surface 42 of the ported housing 24, and an exterior surface 44 of the inner sleeve 34 define an annular space 45, which is partially occupied by a shifting sleeve 46 having an upper portion 48 and a lower locking portion 50 having a plurality of radially-outwardly oriented locking dogs 52.

The annular space 45 comprises an upper pressure chamber 53 defined by the top connection 22, burst disk 32, outer housing 24, inner sleeve 34, the shifting sleeve 46, and upper sealing elements 62*u*. The annular space 45 further comprises a lower pressure chamber 55 defined by the bottom connection 28, the outer housing 24, the inner sleeve 34, the shifting sleeve 46, and lower sealing elements 621. Lower pressure chamber 55 may also be referred to as a receiving chamber as it functions to receive the shifting sleeve 46 following the creation of a pressure differential across the shifting sleeve as described below. In a preferred embodiment, the pressure within the upper and lower pressure chambers 53, 55 is atmospheric when the tool is installed in a well (i.e., the burst disk 32 is intact).

A locking member 58 partially occupies the annular space 45 below the shifting sleeve 46 and ported housing 24. When the sleeve is shifted, the locking dogs 52 engage the locking member 58 and inhibit movement of the shifting sleeve 46 toward the shifting sleeve's first position.

The shifting sleeve 46 is moveable within the annular space 45 between a first position and a second position by application of hydraulic pressure to the tool 20. When the shifting sleeve 46 is in the first position, which is shown in FIGS. 1-2, fluid flow from the interior to the exterior of the tool through the housing ports 26 and sleeve ports 40 is impeded by the shifting sleeve 46 and surrounding sealing elements 62. Shear pins 63 may extend through the ported housing 24 and engage the shifting sleeve 46 to prevent unintended movement toward the second position thereof, such as during installation of the tool 20 into the well. Although shear pins 63 function in such a manner as a secondary safety device, alternative embodiments contemplate operation without the presence of the shear pins 63. For example, the downhole tool may be installed with the lower pressure chamber containing fluid at a higher pressure than the upper pressure chamber, which would tend to move and hold the shifting sleeve in the direction of the upper pressure chamber.

To shift the sleeve 46 to the second position (shown in FIG. 3-4), a pressure greater than the rated pressure of the burst disk 32 is applied to the interior of the tool 20, which may be done using conventional techniques known in the art. This causes the burst disk 32 to rupture and allows fluid to flow through the fluid path 30 to the annular space 45. In some embodiments, the pressure rating of the burst disk 32 may be lowered by subjecting the burst disk 32 to multiple pressure cycles. Thus, the burst disk 32 may ultimately be ruptured by a pressure which is lower than the burst disk's 32 initial pressure rating.

Figure 3:
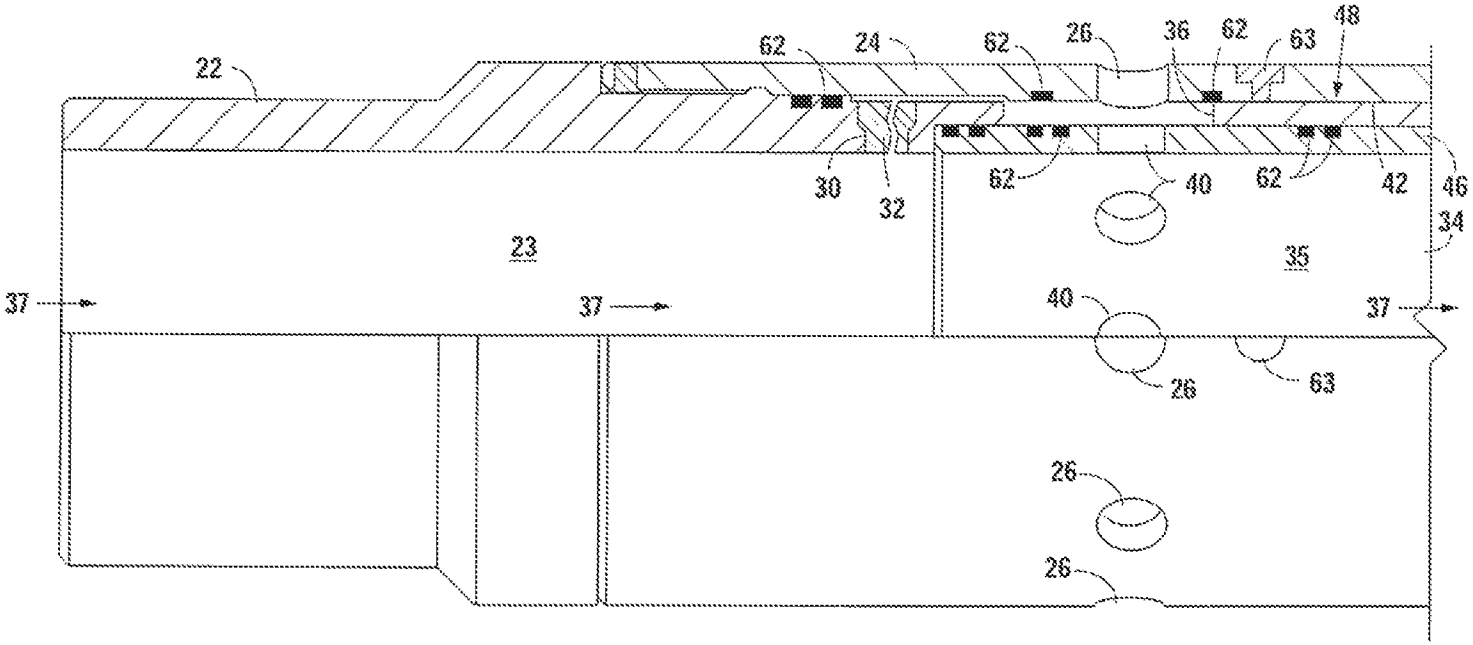
FIGS. 3-4 are partial sectional side elevations of one embodiment in the open position.
Figure 4:
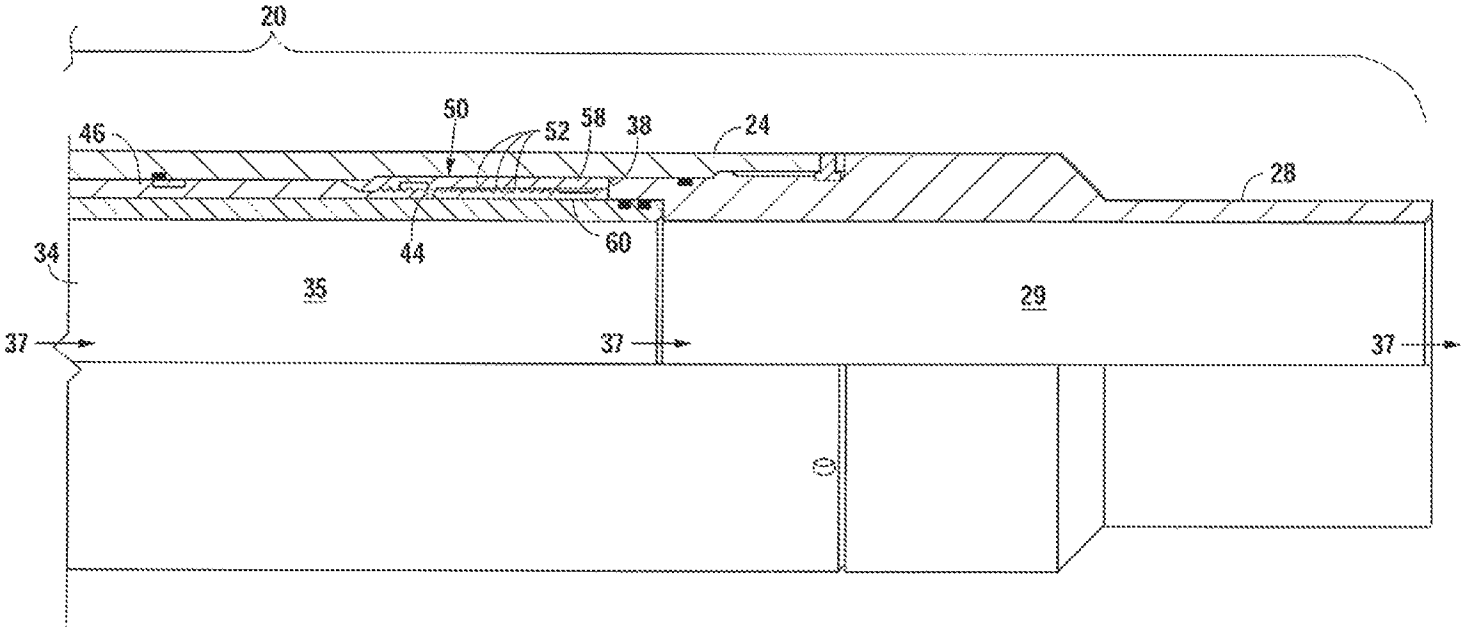

Following rupture of the burst disk 32, the shifting sleeve 46 is no longer isolated from the fluid flowing through the inner sleeve 34. The resultant increased pressure on the shifting sleeve surfaces in fluid communication with the upper pressure chamber 53 creates a pressure differential relative to the atmospheric pressure within the lower pressure chamber 55. Such pressure differential across the shifting sleeve causes the shifting sleeve 36 to move from the first position to the second position shown in FIG. 3-4, provided the force applied from the pressure differential is sufficient to overcome the shear pins 63, if present. In the second position, the shifting sleeve 46 does not impede fluid flow through the housing ports 26 and sleeve ports 40, thus allowing fluid flow between the interior flow path and the exterior of the tool. As the shifting sleeve 46 moves to the second position, the locking member 58 engages the locking dogs 52 to prevent subsequent upwell movement of the sleeve 46.

Figure 5:
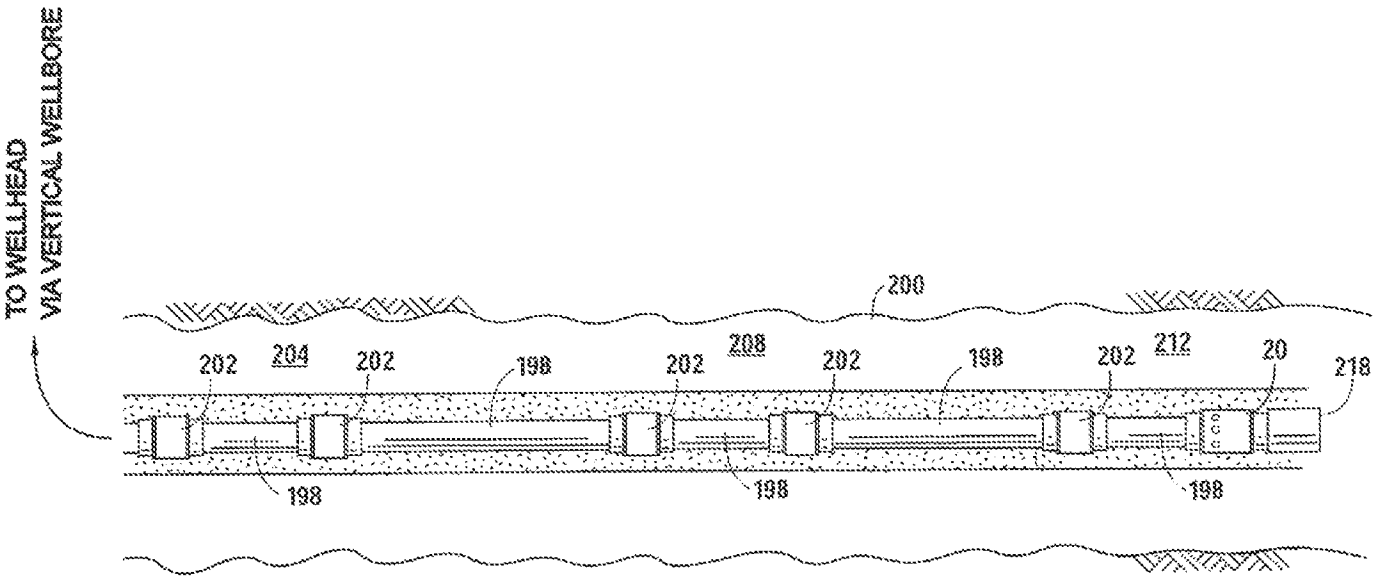
FIG. 5 is a side sectional elevation of a system incorporating an embodiment of the downhole tool described with reference to FIGS. 1-4.

Upper pressure chamber 53 serves as an inlet chamber, as it receives fluid flow, and therefore fluid pressure, that passes the burst disk 32 following rupture. Similarly, the lower pressure chamber 55 serves as a receiving chamber for receiving the shifting sleeve 46 as it moves to the second position in response to the pressure differential caused by increased fluid pressure in the upper pressure, or inlet, chamber 53. FIG. 5 shows the embodiment described with reference to FIGS. 1-4 in use with tubing 198 disposed into a lateral extending through a portion of a hydrocarbon producing formation 200, with the tubing 198 having various downhole devices 202 positioned at various stages 204, 208, 212 thereof. The tubing 198 terminates with a downhole tool 20 having the features described with reference to FIGS. 1-4 and a plugging member 218 (e.g., bridge plug) designed to isolate flow of fluid through the end of the tubing 198. Initially, the tool 20 is in the state described with reference to FIGS. 1-2.

Prior to using the tubing 198, the well operator may undertake a number of integrity tests by cycling and monitoring the pressure within the tubing 198 and ensuring pressure loss is within acceptable tolerances. This, however, can only be done if the downwell end of the tubing 198 is isolated from the surrounding formation 200 with the isolation member 218 closing off the toe of the tubing 198. After testing is complete, the tool 20 may be actuated as described with reference to FIGS. 3-4 to open the toe end of tubing 198 to the flow of fluids.

Figure 6A:
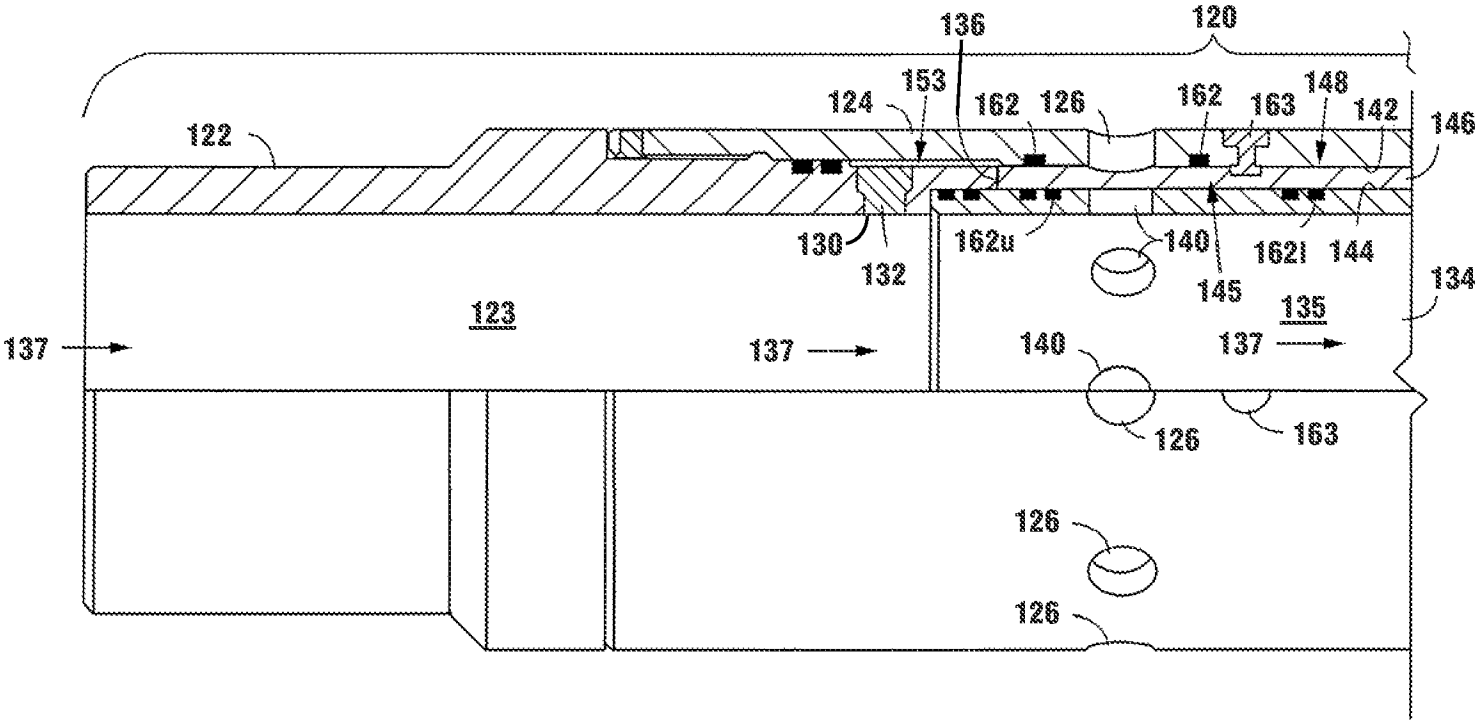
FIGS. 6A & 6B are partial sectional side elevations of an embodiment tool having an outlet conduit which is in the closed position.
Figure 6B:
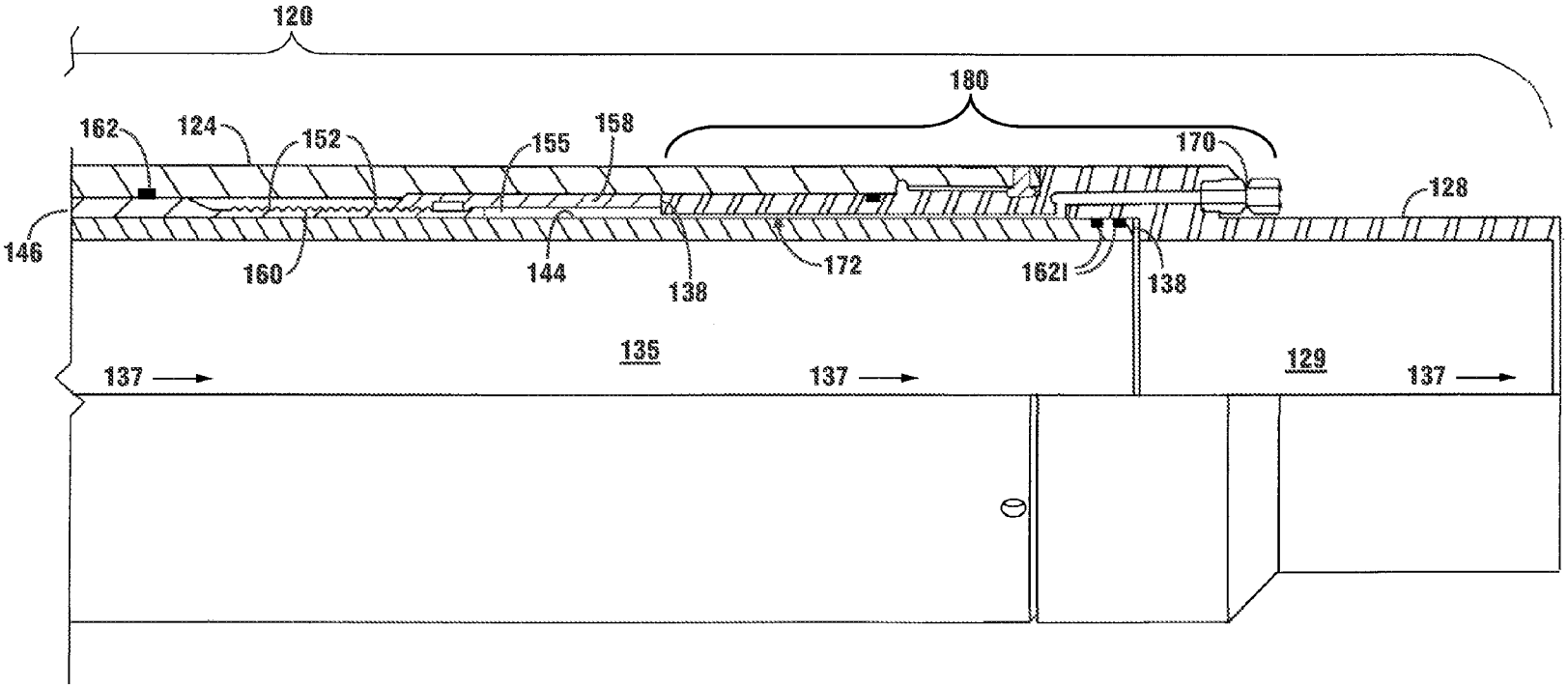

In another embodiment, downhole tools of the present disclosure may be placed in series such that actuation of an embodiment tool facilitates fluid communication between the interior flowpath of the actuated tool and least one other tool. FIGS. 6A-B, 7B and 8A-B depict an embodiment downhole tool 120 for creating such fluid communication. Downhole tool 120 comprises a top connection 122 connected to, such as by threading, an inlet end of ported housing 124, the ported housing having, in certain embodiments, a plurality of radially-aligned housing ports 126. In the embodiment of FIG. 6B, bottom connection is replaced with outlet sub 128 which is similarly connected to an outlet end of the ported housing 124. The top connection 122 and outlet sub 128 have inner surfaces 123, 129, respectively, which may be cylindrical. A fluid path 130 through the wall of the top connection 122 is filled with a burst disk 132 that will rupture when a pressure exceeding the burst disk's rated pressure is applied to the interior of the tool 120.

An inner sleeve 134 having a cylindrical inner surface 135 is positioned between a lower annular surface 136 of the top connection 122 and an upper annular surface 138 of the outlet sub 128. The inner sleeve 134 may have a plurality of radially aligned sleeve ports 140. One or more of the sleeve ports 140 may be aligned with a corresponding housing port 126. The inner surfaces 123, 129 of the top connection 122 and outlet sub 128 and the inner surface 135 of the inner sleeve 134 define an interior flowpath 137 for the movement of fluids into, out of, and through the tool. In an alternative embodiment, the interior flowpath 137 may be defined, in whole or in part, by the inner surface of the shifting sleeve 146.

Although the housing ports 126 and sleeve ports 140 are shown as cylindrical channels between the exterior and interior of the tool 120, the housing ports 126 and sleeve ports 140 may be of any shape sufficient to facilitate the flow of fluid therethrough for the specific application of the tool. For example, larger ports may be used to increase flow volumes, while smaller ports may be used to reduce cement contact in cemented applications or to equalize or otherwise regulate the fluid flow when multiple stages are being treated simultaneously through a plurality of tools, such as through a plurality of open downhole tools of the present disclosure. Housing ports may also have nozzles to control the flow rate through the ports, such as to enable the operator to equalize flow rates through the ports of multiple tools open to fluid flow at the same time. Moreover, while preferably concentrically aligned, each of the sleeve ports 140 need not be concentrically aligned with its corresponding housing port 126 but the ports will generally be arranged to allow for fluid flowing through the sleeve ports 140 to effectively flow through the housing ports 126 as well. The top connection 122, the outlet sub 128, an interior surface 142 of the ported housing 124, and an exterior surface 144 of the inner sleeve 134 define an annular space 145, which is partially occupied by a shifting sleeve 146. Shifting sleeve 146 has an upper portion 148 and a lower portion, such as lower locking portion 150 having a plurality of radially-outwardly oriented locking dogs 152, which may be ratcheting teeth. The locking dogs 152 may be directly milled, cut or otherwise placed into the shifting sleeve 146 or may be placed on a ring or other component that is connected to or engaged with shifting sleeve 146.

The annular space 145 comprises an inlet chamber 153, also referred to as an upper pressure chamber defined by the top connection 122, burst disk 132, outer housing 124, inner sleeve 134, the shifting sleeve 146, and upper sealing elements 162*u*. The annular space 145 further comprises a receiving chamber 155 defined by the outlet sub 128, the outer housing 124, the inner sleeve 134, the shifting sleeve 146, and lower sealing elements 166. Receiving chamber 155 may also be referred to as a lower pressure chamber. In a preferred embodiment, the pressure within the inlet and receiving chambers (153, 155) is atmospheric when the tool is installed in a well (i.e., the burst disk 132 is intact).

A locking member 158 partially occupies the annular space 145 below the shifting sleeve 146, i.e. in the receiving chamber 155. When the sleeve is shifted, the locking dogs 152 engage the locking member 158 and inhibit movement of the shifting sleeve 146 toward the shifting sleeve's first position.

Figure 7A:
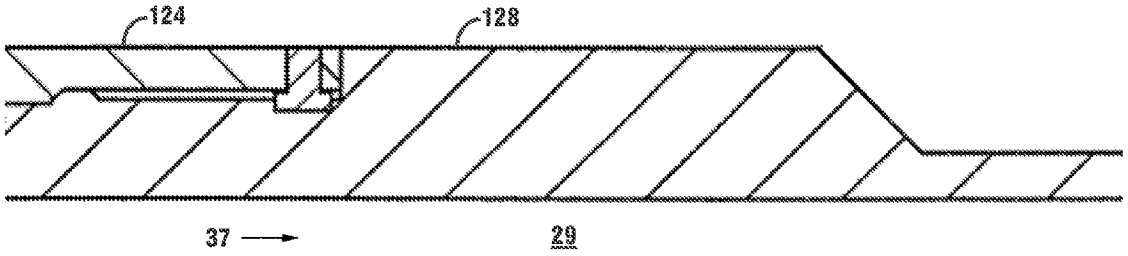
FIG. 7A is an enlarged view of the bottom connection of the embodiment tool of FIGS. 1-4.
Figure 7B:
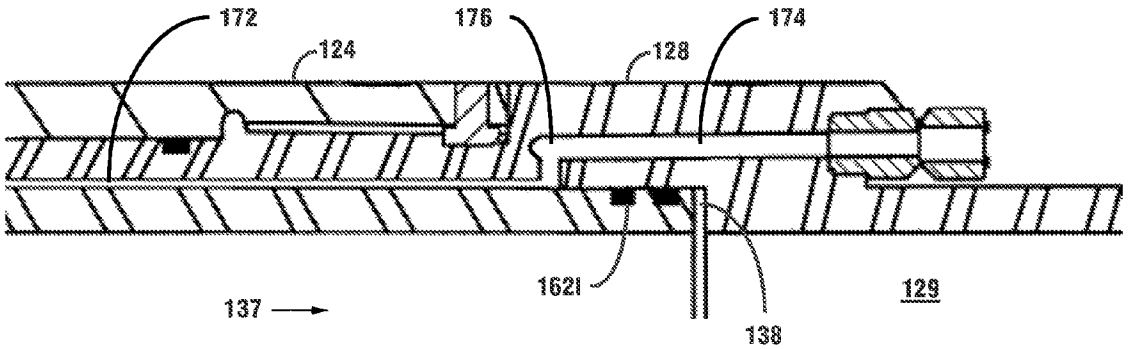
FIG. 7B is an enlarged view of a portion of the outlet sub portion of the embodiment tool of FIGS. 6A & 6B and 8A & 8B.

In the embodiment of FIGS. 6 and 8, outlet sub 128 comprises an outlet flowline connection 170 and an outlet sub flowpath 174, as more clearly shown in FIG. 7B. Further, the outlet sub 128 and inner sleeve 134 at least partially define a mandrel flowpath 172 connected to outlet sub flowpath 174 by outlet radial groove 176. Mandrel flowpath 172 may include longitudinal grooves (not shown) in either inner sleeve 134 or outlet sub 128, though such grooves are not required and sufficient flow may be obtained by allowing fluid to pass between the inner sleeve 134 and the outlet sub 128 without such grooves. It will be appreciated that in the embodiment of FIG. 6B, receiving chamber 155 is in fluid communication with mandrel flowpath 172, outlet connection flowpath 164, and outlet flowline connection 170. Collectively, mandrel flowpath 172, radial groove 176 and outlet sub flowpath 174 comprise one embodiment of an outlet conduit 180. Flow tubing, not shown, may be connected to the outlet flowline connection 170, and thereby the outlet conduit 180, on one end and a separate device, such as another downhole tool, on the flow tubing's other end, thereby bringing such other device, or desired portion thereof, into fluid communication with the receiving chamber 155.

The shifting sleeve 146 is moveable within the annular space 145 between a first position and a second position by application of hydraulic pressure to the tool 120. When the shifting sleeve 146 is in the first position, which is shown in FIGS. 6A and 6B, fluid flow from the interior to the exterior of the tool through the housing ports 126 and sleeve ports 140 is impeded by the shifting sleeve 146 and surrounding sealing elements 162 and 166. Shear pins 163 may extend through the ported housing 124 and engage the shifting sleeve 146 to prevent unintended movement toward the second position thereof, such as during installation of the tool 120 into the well. Although shear pins 163 function in such a manner as a secondary safety device, alternative embodiments contemplate operation without the presence of the shear pins 163. For example, the downhole tool may be installed with the receiving chamber 155 with a spring, collet ring, or other device to hold the shifting sleeve 146 in the first position until actuation as described below.

To shift the sleeve 146 to the second position (shown in FIG. 8A-8B), a pressure greater than the rated pressure of the burst disk 132 is applied to the interior of the tool 120, which may be done using conventional techniques known in the art. This causes the burst disk 132 to rupture and allows fluid to flow through the fluid path 130 to the annular space 145, and specifically the inlet chamber 153. In some embodiments, the pressure rating of the burst disk 132 may be lowered by subjecting the burst disk 132 to multiple pressure cycles. Thus, the burst disk 132 may ultimately be ruptured by a pressure which is lower than the burst disk's 132 initial pressure rating.

Figure 8A:
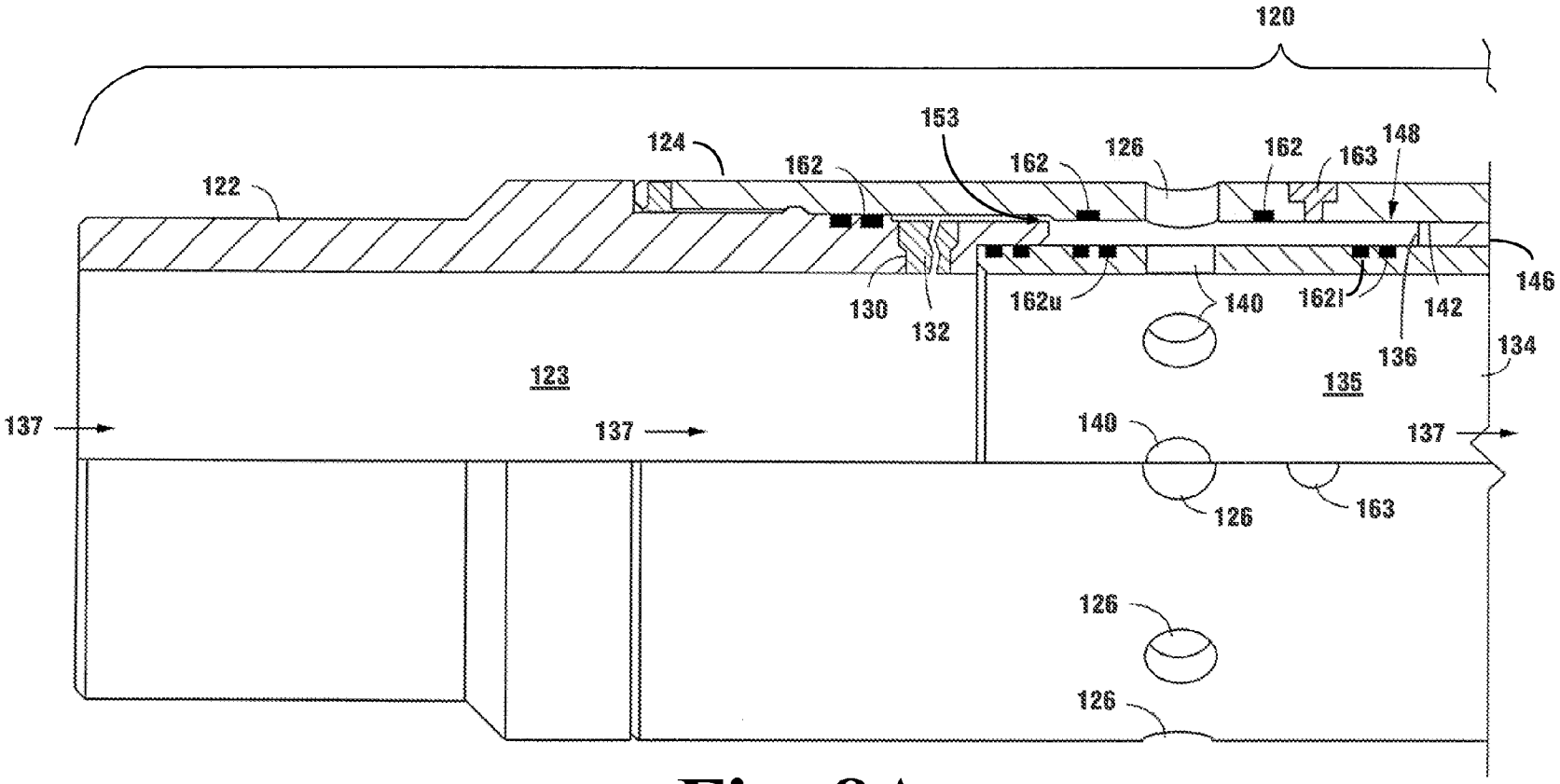
FIGS. 8A & 8B are partial sectional side elevations of an embodiment tool having an outlet conduit which is in the open position.
Figure 8B:
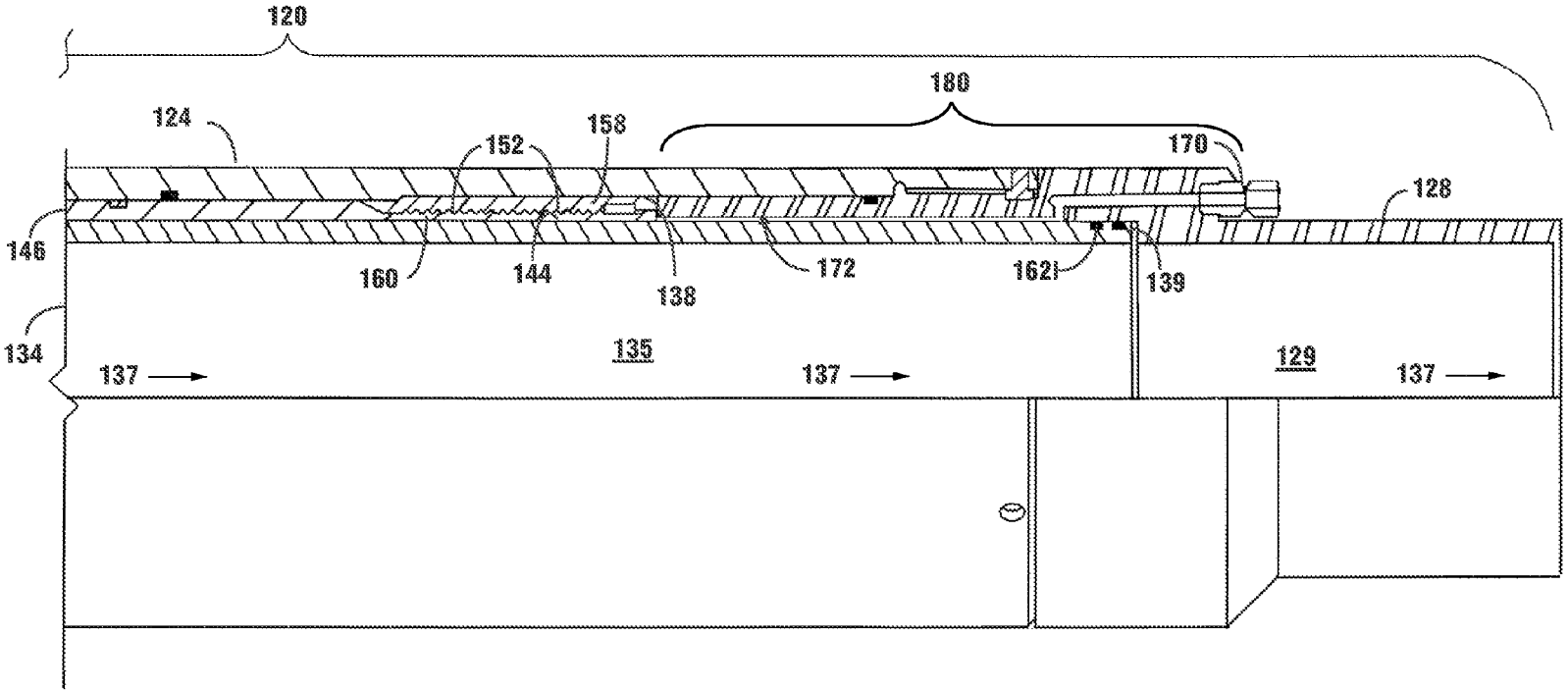

Following rupture of the burst disk 132, the shifting sleeve 146 is no longer isolated from the fluid flowing through the inner sleeve 134. The resultant increased pressure on the shifting sleeve 146 surfaces in fluid communication with the inlet chamber 153 creates a pressure differential relative to the atmospheric pressure within the receiving chamber 155. Such pressure differential across the shifting sleeve 146 causes the shifting sleeve 146 to move from the first position to the second position shown in FIG. 8A-8B, provided the force applied from the pressure differential is sufficient to overcome the shear pins 163, if present. In the second position, the shifting sleeve 146 does not impede fluid flow through the housing ports 126 and sleeve ports 140, thus allowing fluid flow between the interior flow path and the exterior of the tool. As the shifting sleeve 146 moves to the second position, the locking member 158 engages the locking dogs 152 to prevent subsequent upwell movement of the shifting sleeve 146.

Movement of shifting sleeve 146 from the first position to the second position establishes fluid communication between the interior flowpath 137 of downhole tool 120 and a second device via flow tubing connected to the outlet flowline connection 170. Specifically, seals 166 are positioned to engage the shifting sleeve when the shifting sleeve is in the first position in order to prevent fluid communication between the interior flowpath 137 and the receiving chamber 155 through the ports 140. When the shifting sleeve 146 moves to the second position, as in FIGS. 8A-8B, seals 166 no longer engage the shifting sleeve 146 and fluid communication between the interior flowpath 137 and the receiving chamber 155 is established. Because receiving chamber 155 is in fluid communication with the flow tubing via the outlet conduit 180 and outline flowline connector 170, fluid communication is thereby established from interior flowpath 137 to a tool connected to the opposing end of the flow tubing.

FIGS. 7A and 7B show differences between the bottom sub of FIG. 2 (in FIG. 7A) and the outlet sub of FIG. 6B (in FIG. 7B), showing the changes made to facilitate the presence of the outlet conduit of embodiment tool 120.

FIGS. 9-12 depict another embodiment downhole tool 375, configured to actuate in response to fluid pressure received through flow tubing communicating fluid pressure from a remotely positioned device such as tool 120 of FIG. 6A-6B. Such downhole tool 375, may be referred to as an intermediate tool. Intermediate tools are configured such that fluid pressure may be transmitted from it to an additional tool or other device via flow tubing connected to an outlet flowline connector.

Figure 9:
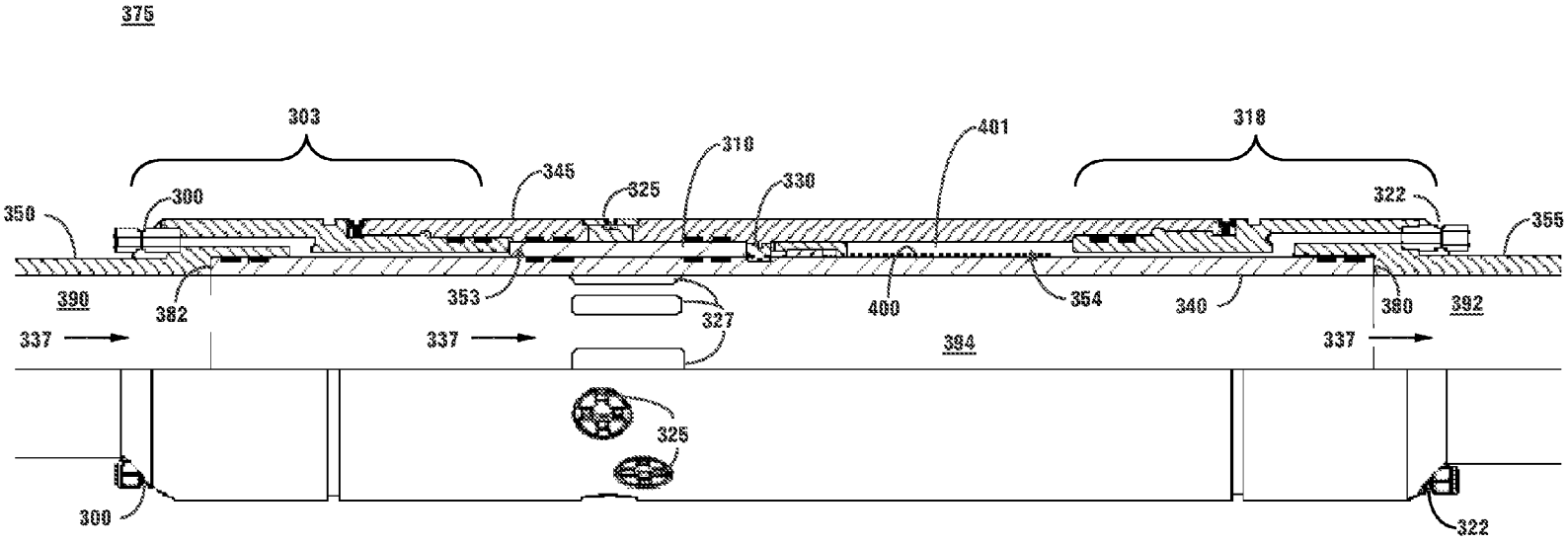
FIG. 9 is sectional side elevation of one embodiment of an intermediate tool in the closed position.

One embodiment intermediate tool 375 is shown in FIG. 9. Intermediate tool 375 comprises an inlet sub 350 connected, such as by threading, to an inlet end of ported housing 345 having a plurality of radially-aligned housing ports 325. An outlet sub 355 is similarly connected to an outlet end of ported housing 345. The inlet sub 350 and outlet sub 355 have cylindrical inner surfaces 390 and 392. An inner sleeve or mandrel 340 having a cylindrical inner surface 394 is positioned between inlet sub annular surface 382 and outlet sub annular surface 380. The inner sleeve or mandrel 340 has a plurality of radially-aligned sleeve ports 327 aligned, such as concentrically aligned, with a corresponding housing port 325.

The inner surfaces 390, 392 of the inlet sub 350 and outlet sub 355 and the inner surface 394 of the inner sleeve 340 define an interior flowpath 337 for the movement of fluids into, out of, and through the tool 375. In an alternative embodiment, the interior flowpath 337 may be defined, in whole or in part, by the inner surface of the shifting sleeve 310. Inlet sub 350, outlet sub 355, an interior surface 401 of ported housing 345, and an exterior surface 400 of the inner sleeve or mandrel 340 define an annular space 315 (indicated by the bracket in FIGS. 10C and 12), which is partially occupied by shifting sleeve 310.

As will be appreciated from the foregoing description, intermediate tool 375 is similar to the other downhole tool embodiments described herein (see, e.g. FIG. 1, item 20 and FIG. 6, item 120) having a similar nested sleeve moveable from a first position to a second position in response to fluid pressure applied to an end of the sleeve. However, instead of the burst disk filled passageway (FIG. 1 item 30, FIG. 6 item 130) allowing fluid communication between the interior flowpath (FIG. 1, item 37 and FIG. 6, item 137) and the inlet, or upper, pressure chamber (FIG. 1, item 53 and FIG. 6, item 153) the intermediate tool receives fluid flow and pressure from a flow tube exterior to the tubing string via inlet flowline connector 300, connected to the inlet sub 355, which is in fluid communication with inlet pressure chamber 353 via an inlet conduit 303. Such arrangement enables communication of fluid and pressure from the exterior flow tub to engage inner sleeve 310 to move inner sleeve 310 from a first position to a second position (e.g. from a closed position to an open position). Thus, rather than actuating in response to fluid pressure in internal flow path 337, intermediate tool 375 is actuated by fluid pressure communicated to it from outside the tool.

Receiving chamber 354 is in fluid communication with outlet flow line connector 322 through outlet conduit 318. Seals (313, 314) discussed in more detail below, prevent fluid communication between the inlet pressure chamber 353 and receiving chamber 354 on the one hand, and the interior flowpath 337 and the exterior of the tool on the other hand.

Figure 10A:
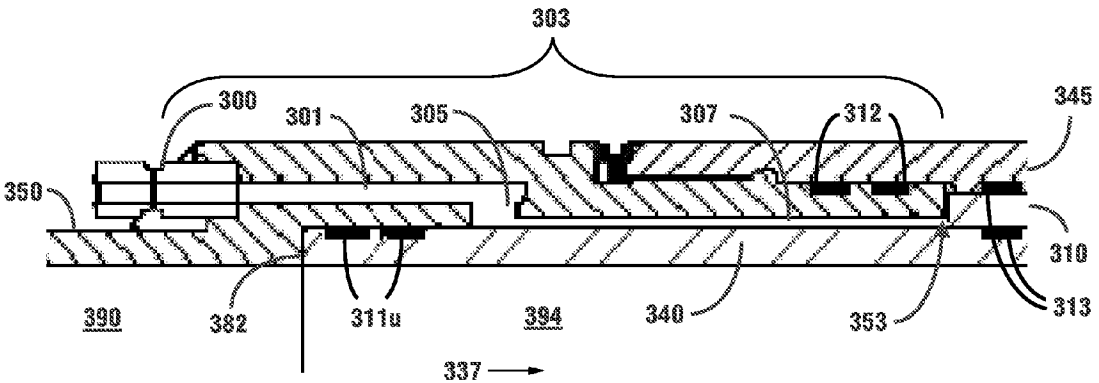
FIG. 10A is an enlarged view of the inlet conduit and adjacent structures of the embodiment of FIG. 9.
Figure 10B:
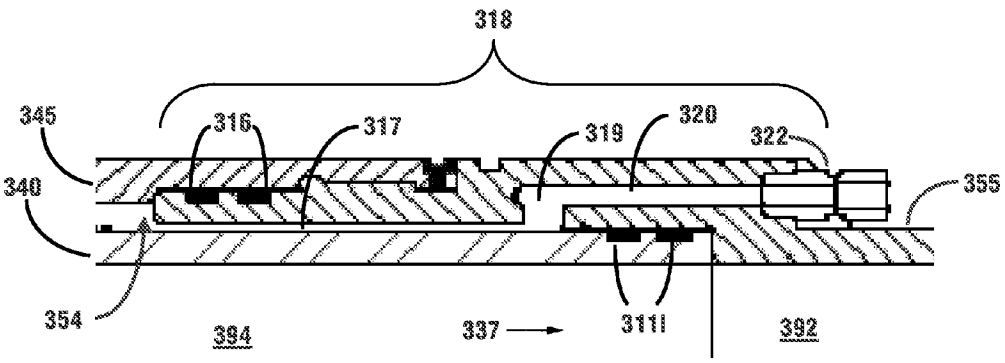
FIG. 10B is an enlarged view of the outlet conduit and adjacent structures of the embodiment of FIG. 9.
Figure 10C:
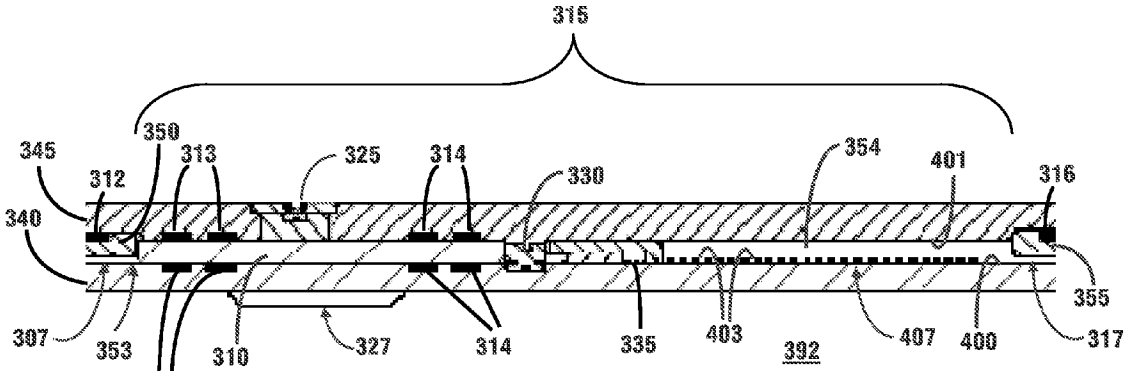
FIG. 10C is an enlarged view of the annular space, shifting sleeve, and adjacent structures of the embodiment of FIG. 9.

FIGS. 10A, 10B, and 10C are enlarged views of inlet, outlet, and center portions, respectively, of downhole tool 375. In the embodiment shown in FIG. 10A, inlet conduit 303 comprises inlet housing passageway 301, inlet radial groove 305, and inlet mandrel passageway 307. Radial groove 305 provides the necessary depth to connect the longitudinal passages, inlet housing passage 301 and inlet mandrel passage 307, despite the different radii at which the longitudinal passages lie. Inlet mandrel passageway 307 connects to inlet pressure chamber 353 bringing inlet pressure chamber 353, and thereby one end of shifting sleeve 310, into fluid communication with inlet conduit 303 and the external flow line. Seals 312 in inlet sub 350 engage the ported housing 345 to prevent fluid communication between the inlet pressure chamber 353 and the exterior of the tool. Seals 311*u* on mandrel 340 engage the inlet sub 350 to prevent fluid communication between the inlet conduit 303 and the interior flowpath 337.

With reference to FIG. 10B, outlet conduit 318 comprises outlet housing passageway 320, outlet radial groove 319, and outlet mandrel passageway 317. Radial groove 319 provides the necessary depth to connect the longitudinal passages, outlet housing passage 320 and outlet mandrel passage 317, despite the different radii at which the longitudinal passages lie. Outlet mandrel passage 317 connects to receiving chamber 354 bringing receiving chamber 354 into fluid communication with outlet conduit 318 and any external flow line. Seals 316 in outlet sub 355 engage the ported housing 345 to prevent fluid communication with the exterior of the tool. Seals 311*l* on mandrel 340 engage the outlet sub 355 to prevent fluid communication between the outlet conduit 318 and the interior flowpath 337. It will be appreciated that other configurations for these, or other inlet and outlet conduits of the present disclosure are possible and such conduits may comprise any of one or more conduits, passageways, sections of tubing, grooves, channels, or other flowpaths to allow fluid communication between the inlet 300 or outlet 322 flowline connectors and inlet pressure chamber 353 or receiving chamber 354, respectively. Such alternate conduits are within the scope of embodiments contemplated herein.

FIG. 10C shows an expanded view of the shifting sleeve 310, annular space 315 and adjacent structures. Inlet sub 350, ported housing 345, mandrel 340, shifting sleeve 310, housing ports 325, and outlet sub 355 are positioned as described above with reference to FIG. 9. Inlet mandrel passageway 307 connects to inlet pressure chamber 353 and outlet mandrel passageway 317 connects to receiving chamber 354.

A plurality of inlet sleeve seals 313 and outlet sleeve seals 314 in the mandrel and the ported housing engage sliding sleeve 310 to prevent fluid communication around sliding sleeve's 310 interior side—adjacent to the mandrel 340—and exterior side—adjacent to the ported housing 345. Inlet sleeve seals 313 engage the sliding sleeve 310 on the inlet side of sleeve ports 327 and housing ports 325 while outlet sleeve seals engage the sliding sleeve 310 on the outlet side of the sleeve ports 327 and the housing ports 325. Inlet sleeve seals 313 prevent fluid communication between inlet pressure chamber 353 and both the housing ports 325 and the sleeve ports 327. Outlet sleeve seals 314 prevent fluid communication between the receiving chamber 354 and both the housing ports 325 and sleeve ports 327.

Shear pin 330 may be included to engage the shifting sleeve 310 and mandrel 340, holding the shifting sleeve 310 in place. Other retention elements, such as collets, shear rings, springs, or other elements may be included to hold the shifting sleeve 310 in the first position until a predetermined pressure differential is created across the shifting sleeve 310.

Locking portion 407 partially occupies receiving chamber 354 below the shifting sleeve 310 and may comprise a plurality of mandrel teeth 403 configured to engage opposing ring teeth on a locking ring connected to shifting sleeve 310. When the sleeve 310 is shifted, ring teeth 335 engage mandrel teeth 403 along exterior surface 400 of mandrel 340 and inhibit movement of the shifting sleeve 310 back towards its first, e.g. closed, position.

Figure 12:
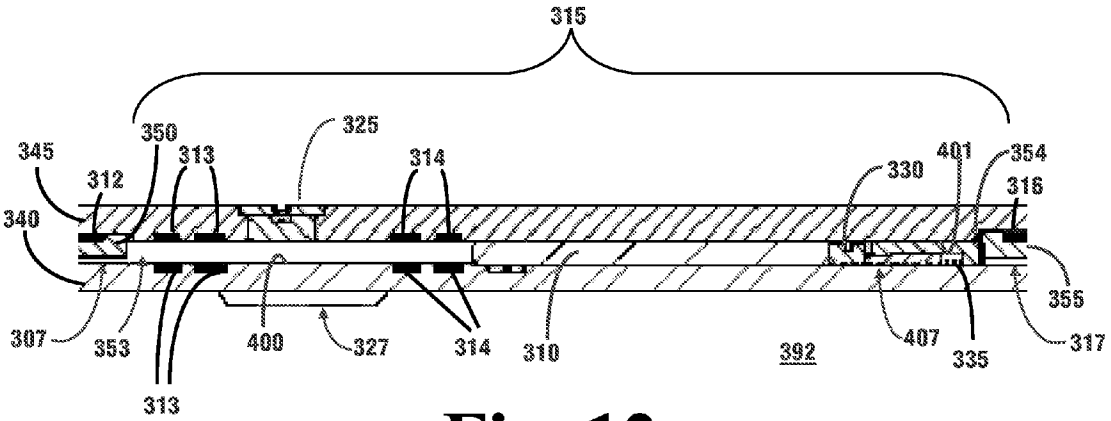
FIG. 12 is an enlarged view of the annular space, shifting sleeve, and adjacent structures of the embodiment of FIG. 11.
Figure 11:
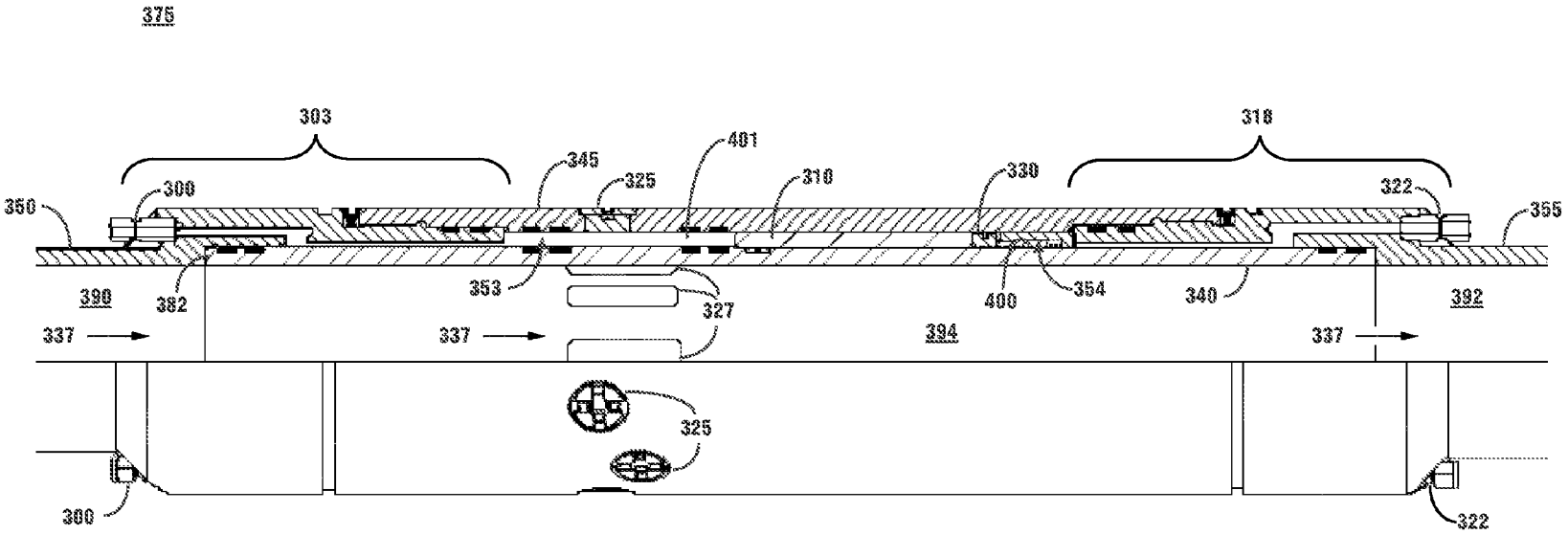
FIG. 11 is sectional side elevation of one embodiment of an intermediate tool in the open position.

The shifting sleeve 310 of downhole tool 375 is moveable within the annular space 315 between a first position, which is shown in FIGS. 9-10, and a second position, which is shown FIGS. 11-12, by application of hydraulic pressure through connection 300 and inlet conduit 303, to the end of shifting sleeve 310. Increased pressure on the shifting sleeve 310 surfaces in fluid communication with the inlet pressure chamber 353 creates a pressure differential relative to the atmospheric pressure within the receiving chamber 354. Such pressure differential across the shifting sleeve 310 causes the shifting sleeve 310 to move from the first position to the second position, provided the force applied from the pressure differential is sufficient to overcome the shear pins 330, if present. In the second position, the shifting sleeve 310 does not impede fluid flow through the housing ports 325 and sleeve ports 327, thus allowing fluid flow between the interior flow path 337 and the exterior of the tool. As the shifting sleeve 310 moves to the second position, the mandrel teeth 403 of locking portion 407 engage the ring teeth 335 to prevent subsequent upwell movement of the shifting sleeve 310.

FIG. 11 shows the intermediate tool 375 with the shifting sleeve 310 in the second position, which may be referred to as the open position or the actuated position. In the second position, shifting sleeve 310 has moved into receiving chamber 354 and thereby enlarges inlet chamber 353. In this position, shifting sleeve 310 no longer prevents fluid communication between interior flowpath 337 and the exterior of the tool through the sleeve ports 327 and housing ports 325.

Further, movement of shifting sleeve 310 from the first position to the second position establishes fluid communication between the interior flowpath 337 of intermediate tool 375 and outlet flowline connection 322, via outlet conduit 318. FIG. 12 is an expanded view of the tool of FIG. 11 showing the shifting sleeve 310 and adjacent structures. Seals 314 are positioned to engage the shifting sleeve 310 when the shifting sleeve 310 is in the first position in order to prevent fluid communication between the interior flowpath 337 and the receiving chamber 354 through the ports 327. When the shifting sleeve 310 moves to the second position, seals 314 no longer engage the shifting sleeve 310 and fluid communication between the interior flowpath 337 and the receiving chamber 354, and thereby to outlet conduit 318 is established by fluid communication around the internal—adjacent to the mandrel 340—and external—adjacent to the ported housing 345—surfaces of shifting sleeve 310. Thus, fluid pressure, and fluid flow, may be communicated out of the intermediate tool 375 to actuate an additional tool or tools via flow tubing connected to outlet flowline connection 322.

It will be appreciated that a downhole tool such as in illustrated in FIGS. 9-12 may be modified such that it is not in fluid communication with an additional tool through an outlet connection. Such a tool may be described as a terminator tool. Modifications to manufacture a terminator tool may include placing a plug in the outlet flowline connection 322 rather than connecting outlet flowline connection 322 to flow tubing. Alternatively, outlet sub 355 may be replaced with an alternative connector sub, such as bottom sub 28 of the embodiment illustrated in FIG. 2 and FIG. 7A. Further, receiving chamber 354 can remain in fluid isolation from the interior flowpath 337 and inlet pressure chamber 353 by positioning inlet sleeve seals 314, or other seals, such that the seals remain engaged with shifting sleeve 310 when shifting sleeve 310 is in the second position.

Figure 13:
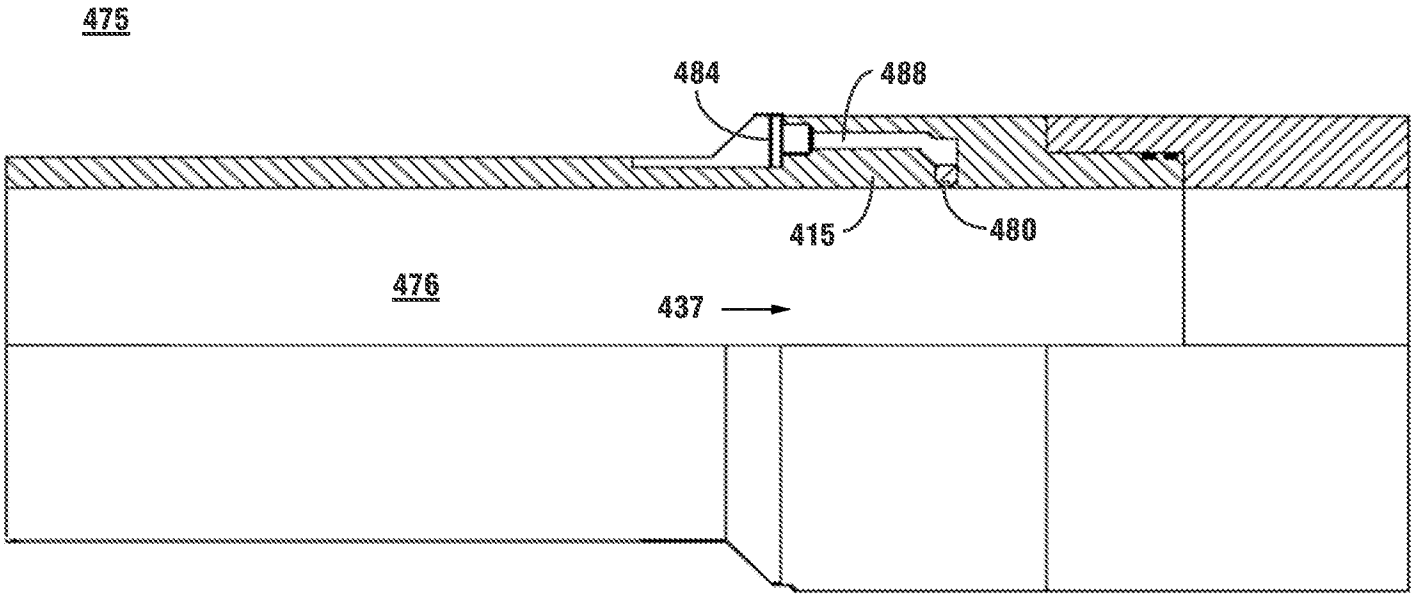
FIG. 13 is sectional side elevation of one embodiment of a portless burst disk initiator tool.

Alternative embodiments of downhole tools according to the present disclosure are also possible. In contrast to the ported valves shown FIGS. 1-4 and 6-12, FIG. 13 illustrates a version of a burst disk initiator 475 without either ports or a shifting sleeve. The burst disk initiator 475 of FIG. 13 is a tubular having an interior wall 415 defining an internal flowpath 437, and an outlet conduit connecting the internal flowpath 437 with an outlet flowline connection 484. Outlet conduit includes a passageway 480 through interior wall 415 connected to a housing passage 488. Burst disk 482 in passageway 480 prevents fluid communication between interior flowpath 437 and the outlet flowline connector 484 via outlet conduit. Fluid pressure in interior flowpath 437 ruptures burst disk 482 when the fluid pressure exceeds the burst disk's 482 rated pressure, allowing fluid communication between interior flowpath 437 and a flowline connected to the outlet flowline connector 484 and thereby to another tool, such as the intermediate tool 375 illustrated in FIGS. 9-12.

Figure 14:
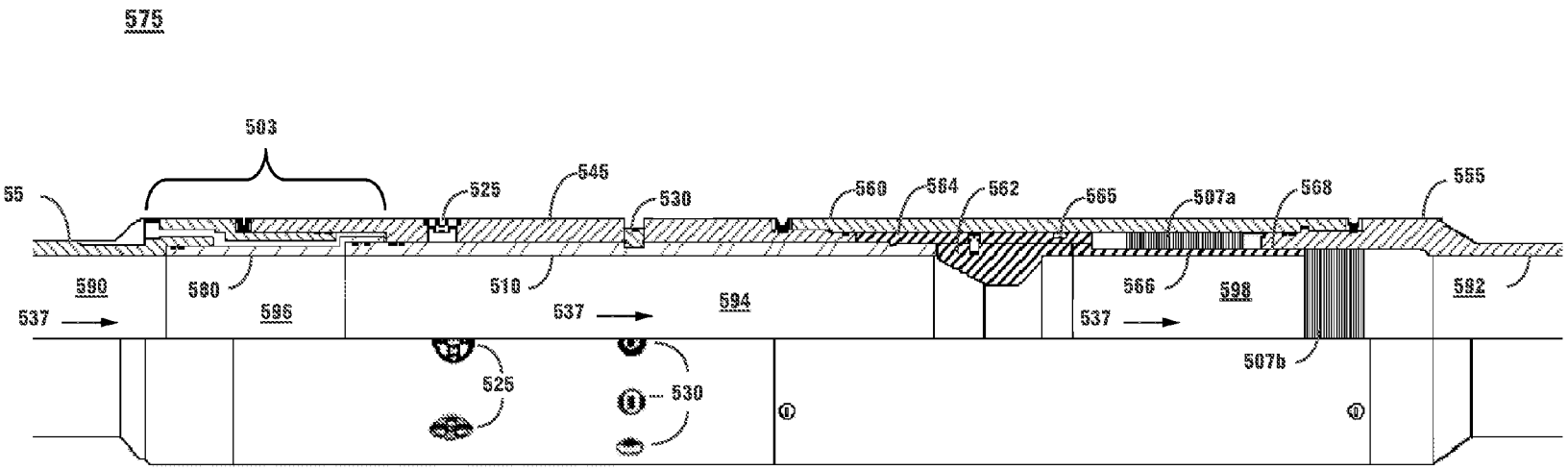
FIG. 14 is sectional side elevation of one embodiment of a plug seat initiator tool in the closed position.

Systems as described herein may also include a plug actuated initiator tool, such as the tool illustrated in FIGS. 14-17. FIG. 14 shows an embodiment initiator tool 575 actuated by a pressure differential created across a plug seat 562. Such a plug seat initiator tool generally has an outlet conduit 503, a sliding sleeve 510, and a plug seat 562 connected to the sliding sleeve 510. Sliding sleeve 510 is configured with a first position and a second position, such that in the first position, the sliding sleeve 510 prevents fluid communication between the interior flowpath 537 and the outlet conduit 503 and in the second position allows fluid communication therebetween.

The embodiment plug seat initiator tool of FIG. 14 comprises an outlet sub 550 connected to a ported housing 545, which may have a plurality of ports 525 therethrough. The tool 575 may further comprise a plug seat housing 560 connecting ported housing 545 and bottom sub 555. Isolation sleeve 580 lies interior to outlet sub 550 and ported housing 545, engaging a lower annular shoulder 582 of outlet housing 550 and an interior surface of ported housing 545. Isolation sleeve 580 has a profile 582 with an enlarged radius for receiving and sealing against sliding sleeve 510. Plug seat 562 may be connected to sliding sleeve 510 by seat carrier 564. In some embodiments, plug seat 562 or seat carrier 564 may have a locking ring 565 with outwardly oriented teeth or dogs to engage opposing teeth 507*a* on the interior of plug seat housing 560. Some embodiments may have a sleeve, such as cement sleeve 566, to prevent cement or other debris from accumulating below the plug seat 562 and seat carrier 564, thereby preventing the plug seat 562, seat carrier 564, and sliding sleeve 510 moving to the second, or open, position. Cement sleeve may have outwardly oriented teeth or dogs 568 configured to engage teeth or dogs 507*b* on an inner surface of bottom connection 555.

One or more shear pins 530 may be connected to the ported housing 545 and the sliding sleeve 510 to prevent movement of the sliding sleeve 510 from the first position to the second position until sufficient force is applied to the sliding sleeve 510, such as by a pressure differential across the plug seat 562, to break the one or more shear pins 530. Shear pins may be placed in additional or other locations, such as connecting the plug seat housing with the seat carrier, or other location, to maintain or help maintain the shifting sleeve in the first position. Further, it will be appreciated that other devices, such as collets, shear rings, springs, or other devices, may be employed to hold the shifting sleeve 510 in the first position until sufficient force is applied to overcome such restriction.

Outlet sub 550, isolation sleeve 580, sliding sleeve 510, plug seat 562, cement sleeve 566, and bottom sub 555 each has a generally tubular inner surface 590, 596, 594, 595, 598, and 592 respectively, which together define an interior flowpath 537 through initiator tool 575.

Figure 15B:
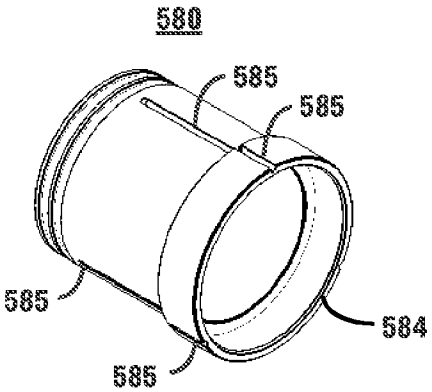
FIG. 15B is an isometric view of the isolation sleeve of the embodiment plug seat initiator tool shown FIG. 14.
Figure 15A:
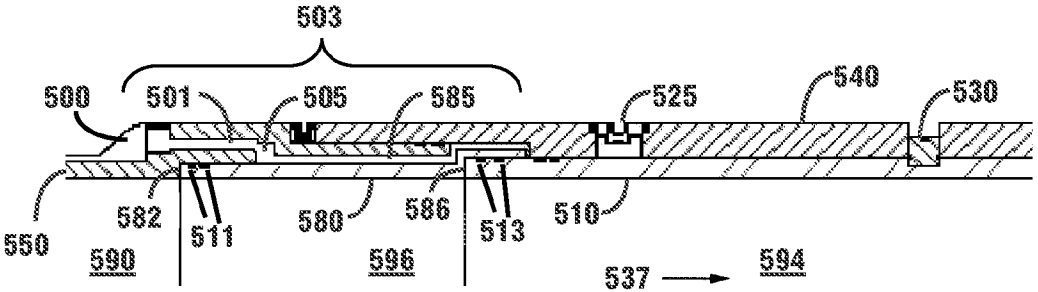
FIG. 15A is an enlarged view of the outlet conduit and adjacent structures of the embodiment plug seat initiator tool of FIG. 14.

FIG. 15A shows an expanded view of the region of the embodiment initiator tool 575 including and adjacent to the isolation sleeve 580. The arrangement of outlet sub 550, ported housing 545, isolation sub 580 and sliding sleeve 510 is as described for FIG. 14. Outlet conduit 503 comprises a housing passageway 501, longitudinal groove 585 and gap 584. Gap 584 may be very small and, in some embodiments, may be the available flowpath remaining between the isolation mandrel 580 and the ported housing 545 after assembly of the tool 575. Seals 511 prevent fluid communication with the interior flowpath 537 and outlet conduit around the isolation mandrel 580. Further, sleeve seals 513 prevent fluid communication with the outlet conduit 503 around the sliding sleeve 510 when the sliding sleeve 510 is in the closed position.

FIG. 15B shows the isolation sleeve 580 with a plurality of longitudinal grooves 585 which make up a portion of the outlet conduit 503.

Figure 17:
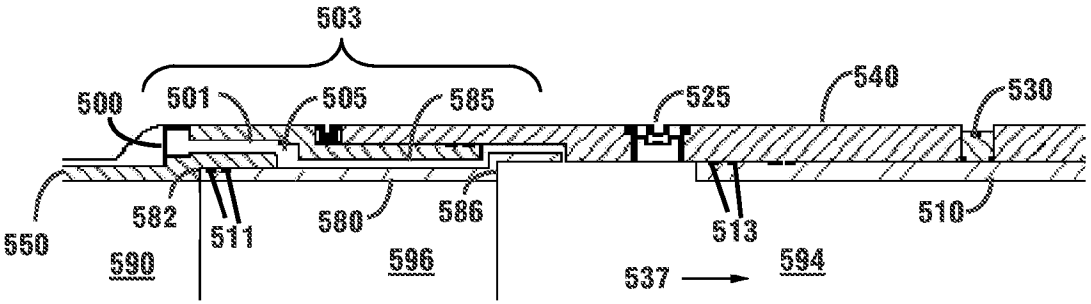
FIG. 17 is an enlarged view of the outlet conduit and adjacent structures of the embodiment plug seat initiator tool of FIG. 16.
Figure 16:
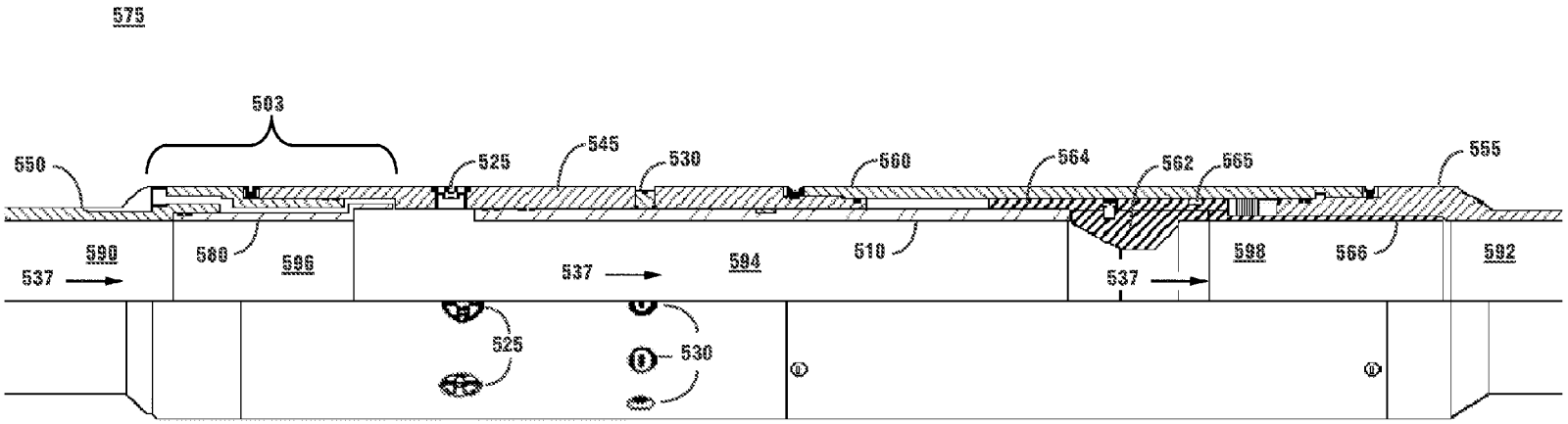
FIG. 16 is sectional side elevation of one embodiment of a plug seat initiator tool in the open position.

A pressure differential created across the plug seat 562—typically by applying fluid pressure to the interior of tubing string while plug seat 562 is engaged with an appropriately sized ball, dart, or other suitable plug—will shift the sleeve 510 from the first position to the second position, shown in FIGS. 16-17. Sliding sleeve 510 has moved sufficiently within the plug seat initiator tool 575 that fluid flowing through interior flowpath 537 may pass through gap 584, establishing fluid communication between the interior flowpath 337, outlet conduit 503 and any flowline connected to outlet connector 500, thereby creating fluid communication with another tool, such as an intermediate tool or a terminator tool, to which such flowline may also be connected. It will be appreciated that outlet connector 500, or any of the connectors may be a threaded connection milled into the tool, welded into the tool, or any other means of connecting a flow line to the tool to permit fluid communication. Further, the sliding sleeve 510 may also be shifted sufficiently to allow fluid communication between the interior flowpath 537 and the exterior of the initiator tool 575 through ports 525, when present.

Figure 18:
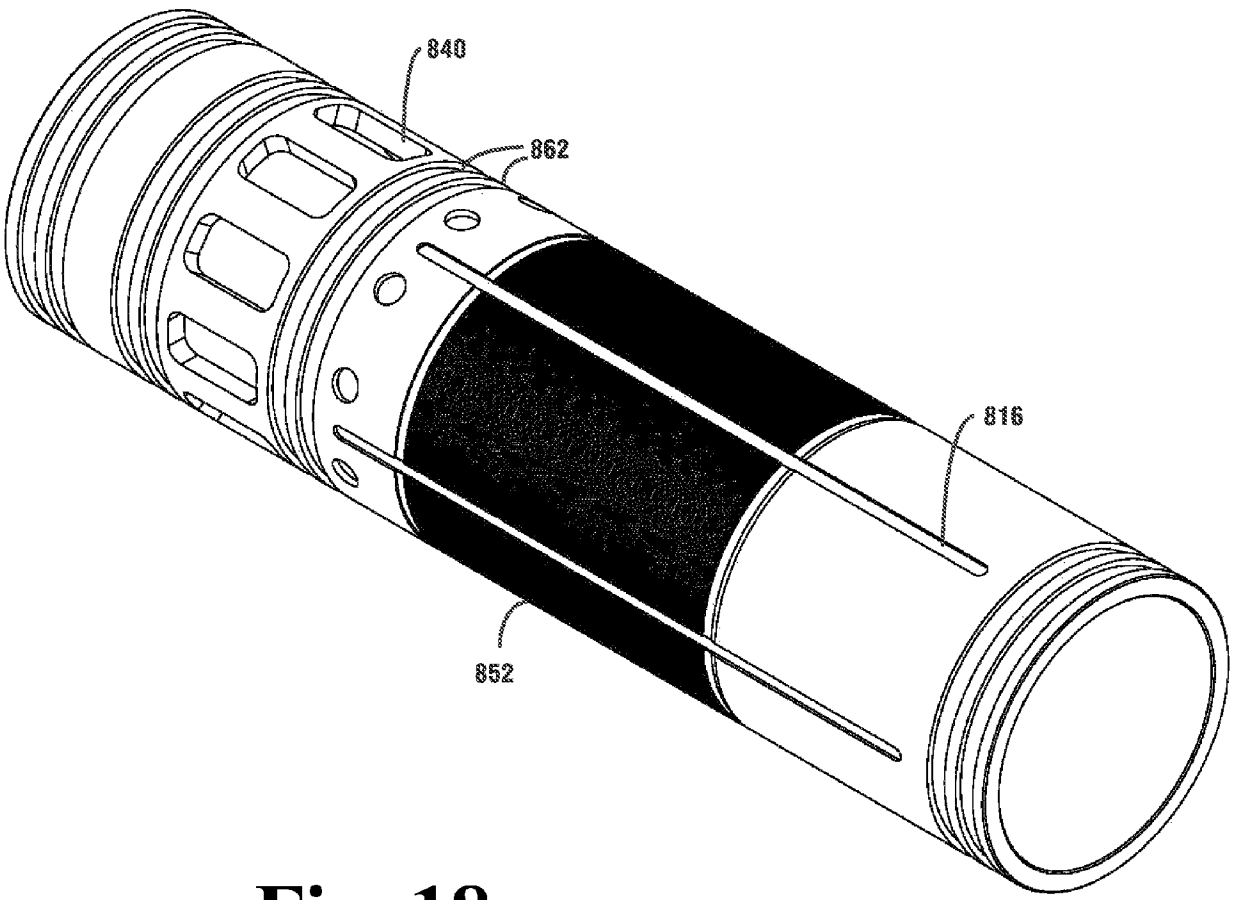
FIG. 18 is external view of an embodiment inner sleeve with flow slots in the outer surface.
Figure 19:
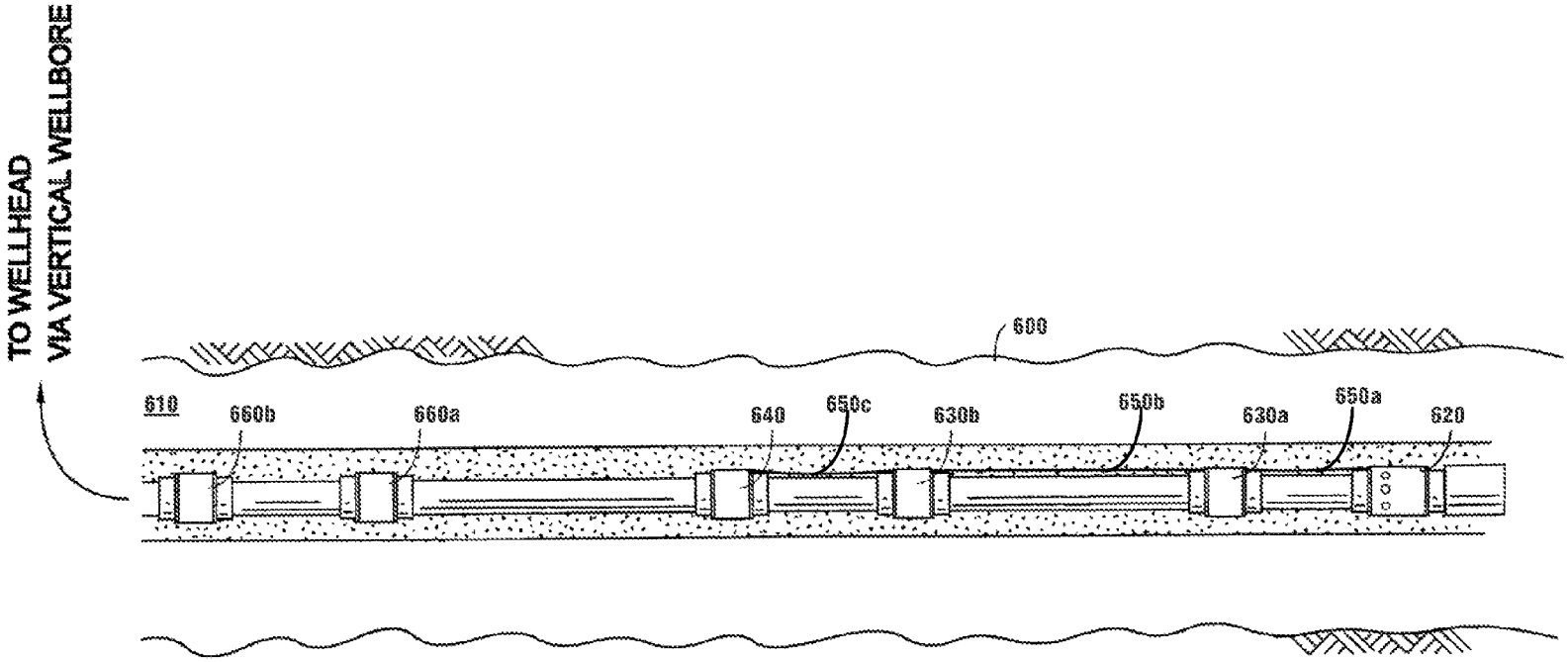
FIG. 19 is a side sectional elevation of a system incorporating an initiator tool, a terminator tool, and two intermediate tools.

In certain embodiments, the inner sleeve may be configured to improve fluid flow, and pressure communication around the shifting sleeve after the shifting sleeve has moved to the second position. For example, flow, and pressure communication, may be restricted by close tolerances between the inner sleeve and shifting sleeve and between the shifting sleeve and housing. One embodiment inner sleeve 834 for flow improvement is shown in FIG. 18. Flow slots 816 are cut longitudinally along the outer surface of inner sleeve 834. When assembled into a valve such as valve 120 (FIG. 6A-B), the slots 816 are isolated from the sleeve ports 840 by the engagement of the shifting sleeve 146 with seals 1621, which lie in seal grooves 862. Further, the slots may cross the teeth 852 as shown, where such teeth are used to engage locking ring teeth, such as in the arrangement described with respect to the embodiments of FIGS. 9-11. Such slots allow for better flow Based on the above description of certain embodiments, systems may be assembled by combining initiator, intermediate, and terminator downhole tools in series. One embodiment series is illustrated by FIG. 19. Tubing string 610 is shown in a horizontal section, or lateral, extending through a portion of a hydrocarbon producing formation 600. It will be appreciated that tools of the present invention may also be used in vertical or deviated sections of wells. An initiator tool 620, such as downhole tool 120 of FIGS. 6-8, intermediate tools (630*a*, 630*b*) such as tool 375 illustrated in FIGS. 9-12, and a terminator tool 640 are placed as desired along the tubing, such as to place ported valves as desired along the formation, or to place an initiator tool sufficiently upwell of the toe to reduce the risk that residual cement in the tubing, (e.g. from a cement tail remaining in the toe) will not prevent actuation of the initiator. Flow lines 650*a-c* connect the outlet flowline connector of initiator tool 620 with the inlet flowline connector of intermediate tool 630*a*; the outlet flowline connector of intermediate tool 630*a* with the inlet flowline connector 630*b*; and the outlet flowline connector 630*b* with inlet flowline connector of terminator tool 640. It will be appreciated that an initiator tool may be paired with a terminator tool without intermediate tools therebetween.

Further, a terminator tool is not strictly necessary, as some intermediate tools, such as intermediate tool 375, will open as desired even where the outlet flowline connector is open to the exterior of the tubing string or is connected to flowline that is open to the exterior of the tubing string.

When the burst disk of initiator tool 620 (e.g. FIG. 6, item 132) is ruptured by fluid pressure in the interior of the tubing string, the initiator tool is actuated and the shifting sleeve (e.g. FIG. 6, item 146) moves from the first position to the second position, bringing the initiator tool 620 outlet flowline connection into fluid communication with the interior of tubing string 610. Flow line 650*a* transmits fluid pressure, and fluid flow, from the initiator tool's 620 outlet flowline connection to the first intermediate tool 630*a* through its inlet flowline connection and inlet conduit to the first intermediate tool's 630*a* inlet pressure chamber (e.g. FIG. 9, item 353) and shifting sleeve (e.g. FIG. 9, item 310). When the fluid pressure transmitted thereby applies sufficient force to the shifting sleeve to shear the shear pins, (e.g. FIG. 9, item 330), the shifting sleeve moves to the second position, allowing fluid communication via housing ports and sleeve ports between the interior and the exterior of the tubing string 610.

Similarly to the initiator tool 620, movement of the shifting sleeve of intermediate tool 630*a* to the second position allows fluid communication between the interior flowpath and outlet flowline connector (e.g. FIG. 9, item 322) of intermediate tool 630*a* via its receiving chamber (e.g. FIG. 9, item 354) and outlet conduit. In this manner, fluid pressure from receiving chamber of intermediate tool 630*a* may be transmitted to shifting sleeve of intermediate tool 630*b* via flow line 650*b*, inlet flowline connector of intermediate tool 630*b* and the inlet conduit of intermediate tool 630*b*, thereby actuating intermediate tool 630*b* with fluid pressure transmitted from receiving chamber of the first intermediate tool 630*a*. Further, additional stages 660*a-b* may be added to the tubing by the inclusion of other sleeves or valves such as traditional plug actuated frac valves or other devices.

Intermediate tools may be strung together in series as desired. While the illustration in FIG. 19 shows two intermediate tools, large numbers of intermediate tools in series are possible because the next tool may be actuated from the interior flowpath of the immediately previous tool and does not necessarily rely on flow through the inlet conduit of the previous tool. Typically, the last tool in the series will be a terminator tool, which has an inlet conduit but either has no outlet conduit the outlet conduit is plugged or the receiving chamber remains sealed to prevent fluid communication with the internal flowpath.

Figure 20:
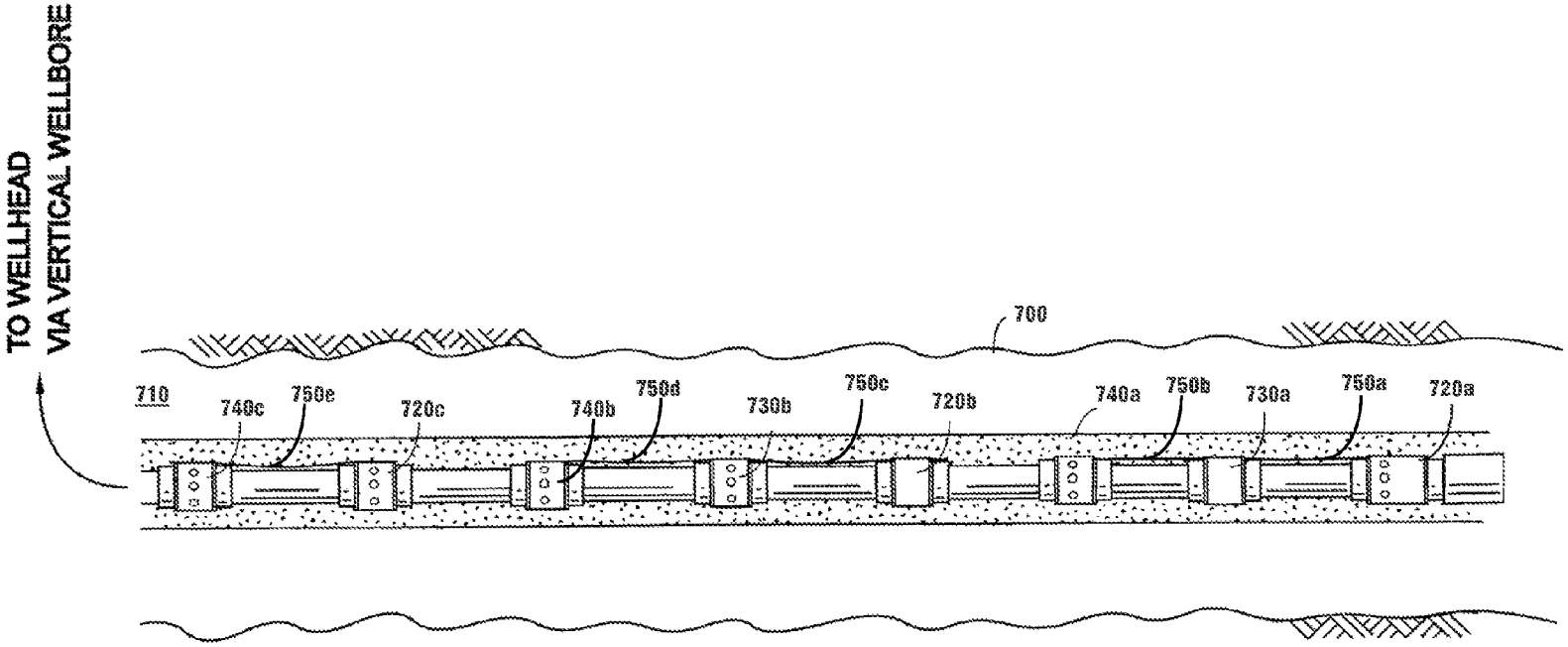
FIG. 20 is a side sectional elevation of a system incorporating multiple series of tools according to the present disclosure.

Multiple series of tools according to the embodiments encompassed herein are possible by placing a plurality of selectively actuatable initiator tools, responsive to different actuation triggers, along the tubing string. Each initiator tool is connected to a series of intermediate and terminator tools, such that each series opens in response to the particular trigger of its associated initiator tool. Such an arrangement is illustrated in FIG. 20. Tubing string 710 penetrates a subterranean formation 700, such as a hydrocarbon bearing formation. Selectively actuatable initiator tools 720*a*, 720*b*, 720*c* are placed in series with at least one terminator tool 740*a*, 740*b*, 740*c*. One or more intermediate tools 730*a*, 730*b* may be placed between the initiator and terminator tools.

In FIG. 20, first series includes first initiator 720*a* is fluidly connected to first intermediate tool 730*a* via flow line 750*a* connected to first initiator tool's outlet flow line connector and first intermediate tools inlet flow line connector. First intermediate tool 730*a* is further connected first terminator tool 740 via flowline 750*b* connected to first intermediate tool's outlet flowline connector and first terminator tools inlet flow line connector.

Similarly to the first series, second series includes second initiator 720*b*, second intermediate 730*b*, and second terminator 740*b* tools connector by flowlines 750*c* and 750*d*. Third series includes third initiator 720*c* and third terminator 740*c* tools connected by flowline 750*e*.

The series are actuated in a desired order by use of the appropriate trigger at the desired time. For example, each initiator 720*a-c* may be a plug seat initiator, such as initiator 575 of FIG. 14, configured to engage different sized plugs. In such configuration, initiator 720*a*, which is the most distal from the wellhead through the tubing string 710, will have a plug seat configured to engage a plug that passes through initiators 720*b* and 720*c* without engaging, or only minimally engaging their respective plug seats. Such first plug is capable of actuating the first series of tools connected to initiator 720*a* without actuating the second or third series of tools connected to initiators 720*b* or 720*c*. Thus, the region of the subterranean formation adjacent to the ported valves of the first series may be treated while the tools of the second series and third series remain closed or otherwise not actuated.

A second plug, which may be larger than the first plug, then engages the plug seat of initiator 720*b* actuating the second series of tools 720*b*, 730*b*, 740*b*. Second plug passes through third initiator 720*c* without actuating the third series 720*c* and 740*c*, such as because the second plug is too small to create sufficient pressure differential across the third initiator tool's 750*c* plug seat to actuate the third series. Further, engagement of the second plug on initiator tool 720*b* prevents fluid communication through the tubing string to the first series of tools connected to initiator 720*a*. Thus, such second plug allows treatment of the formation adjacent to the ported valves of the second series while preventing fluid flow through the ported valves of the first series and leaving the tools of the third series not actuated. A third plug may then engage the plug seat of and actuate the third initiator tool 720*c* and thereby actuate the third series. The engagement of the third plug on the third initiator tool's plug seat may also serve to prevent fluid flow therethrough, thereby allowing treatment of the subterranean formation adjacent to the ported valves of the third series while preventing fluid flow to the ported valves of the second series and the first series.

It will be appreciated that flapper valves or other valves may be incorporated into the tubing string such that plugs do not have to prevent fluid communication to previously actuated series, individual ported valves, perforations, or other structures. The use of flapper valves is contemplated within the scope of the invention as claimed.

Other methods of selectively actuating plug seat operated valves are also known. For example, the initiator tool may comprise a j-slot sleeve and pin assembly or other indexing element, such that the sliding sleeve will not move to the second position until a desired number of pressure cycles have been created across the indexing element. Such indexing element may be paired with an expandable c-ring or other expandable plug seat that releases the plug after generation of the desired pressure differential. Thus, by using plug seat initiators with an indexing element and expandable plug seat, multiple series of tools of the present disclosure may be actuated by using plugs of the same size.

Plug seat initiators may be mixed with burst disk initiators or other initiators in a single tubing string. For example, initiator tool 720*a* may be a burst disk initiator, either a ported valve version (such as initiator tool 120 of FIG. 6) or a portless version (such as initiator tool 475 of FIG. 13) actuated by the application of pressure to the interior of the tubing string 710 according to known methods, allowing treatment of the subterranean formation adjacent to the ported valves of the first series. The second and third initiator tools 720*b*, 720*c* may be plug seat initiator tools. In such an arrangement, the first initiator tool, and therefore the first series, is actuated by applying pressure above the rated pressure of the burst disk in first initiator tool. Such increased pressure would not actuate the plug seat initiators of the second or third series, allowing treatment of the first series.

After treatment of the first series, engagement of an appropriate plug on the plug seat of initiator tool 720*b* both actuates the second series and isolates the open ported valves of the first series from fluid flow occurring at the second series, as described above. Similarly, the third, and subsequent, series of ported valves are actuated, and adjacent areas of subterranean formations are treated, by engagement of subsequent plugs on the plug seats of those series' initiator tools according to known methods.

The downhole tool may be placed in positions other than the toe of the tubing, provided that sufficient internal flowpath pressure can be applied at a desired point in time to create the necessary pressure differential on the shifting sleeve. In certain embodiments, the internal flowpath pressure must be sufficient to rupture the burst disk, shear the shear pin, or otherwise overcome a pressure sensitive control element. However, other control devices not responsive to pressure may be desirable for the present device when not installed in the toe.

The downhole tool as described may be adapted to activate tools associated with the tubing rather than to open a flow path from the interior to the exterior of the tubing. Such associated tools may include a mechanical or electrical device which signals or otherwise indicates that the burst disk or other flow control device has been breached. Such a device may be useful to indicate the pressures a tubing string experiences at a particular point or points along its length. In other embodiments, the device may, when activated, trigger release of one section of tubing from the adjacent section of tubing or tool. For example, the shifting element may be configured to mechanically release a latch holding two sections of tubing together. Any other tool may be used in conjunction with, or as part of, the tool of the present disclosure provided that the inner member selectively moves within the space in response to fluid flow, such as changes in fluid pressure, fluid volume, velocity, pressure cycles, or the like, through the interior flowpath. Numerous such alternate uses will be readily apparent to those who design and use tools for oil and gas wells.

Figure 21:
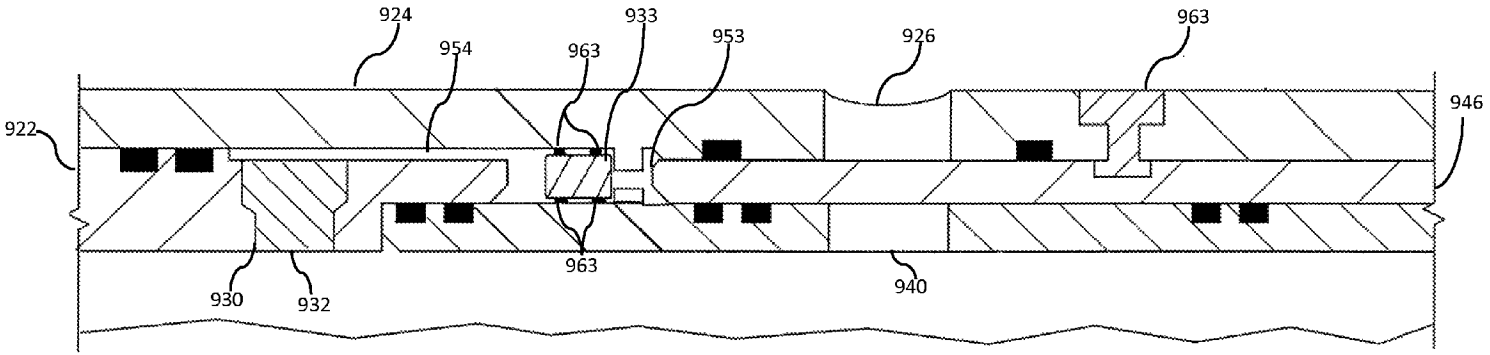
FIG. 21 is an enlarged view of the annular space, shifting sleeve, and adjacent structures of an embodiment downhole tool having a degradable material fluid control device in addition to a burst disk.

FIG. 21 shows an alternative embodiment tool according to the present disclosure. The arrangement of the top connection 922, ported housing 924, inner sleeve 910, shifting sleeve 946 and bottom connection (not shown) are the same as for the embodiment described with reference to FIGS. 1-4. Interior surfaces of inner sleeve, top connection, and bottom connection at least partially define an interior flowpath through the downhole tool. The embodiment of FIG. 21 also has a fluid path comprising a top connection passage 930, a longitudinal passage 954, which may be a groove machined into the top connection, and an upper pressure chamber 953 portion of the annular space. The fluid path connects the interior flowpath with the upper pressure chamber 953 between the inner sleeve 910 and the ported housing 924 and adjacent to an end of the shifting sleeve 946.

The fluid path of the embodiment of FIG. 21 includes two fluid control devices preventing fluid flow therethrough. A burst disk 932 is disposed in the top connection passage 930 and prevents fluid communication between interior flowpath and the longitudinal passage 954. A degrading member 933 is disposed between the longitudinal passage 954 and the upper pressure chamber 953. In certain embodiments, the degrading member may be a magnesium bar of suitable size. Seals 963 engage the degrading member 933 and either or both of the inner sleeve 910 and ported housing 924 to create a seal for preventing the flow of fluids around the degrading member 933.

In operation, fluid pressure us applied to rupture the burst disk allowing fluid flow, and fluid pressure from the interior flowpath through the top connection passage 930 and into the longitudinal passage 954. The fluid in the flowpath is an appropriate fluid for affecting the degrading member 933 as desired. For example, if the degrading member 933 is a magnesium bar, the fluid in the internal flowpath may be hydrochloric acid or other solution that dissolves or otherwise degrades magnesium. In such embodiment, bursting of the burst disk will allow the hydrochloric acid, or other fluid suitable for degrading magnesium, to pass through top connection passage 930 and longitudinal passage 954 to reach the degradable member 933, starting the degradation process.

Figure 22:
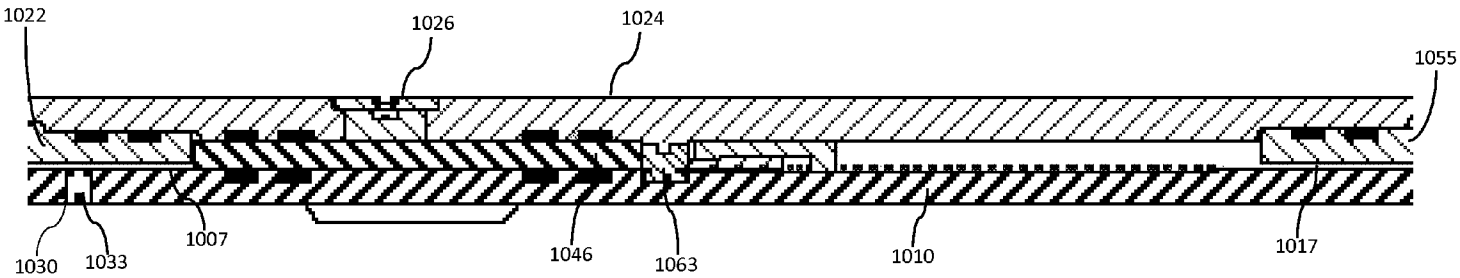
FIG. 22 is an enlarged view of the annular space, shifting sleeve, and adjacent structures of an embodiment downhole tool having a degradable material fluid control device in the inner sleeve and blocking a fluid path connecting the interior flowpath with the inlet mandrel passageway.

FIG. 22 illustrates an embodiment downhole tool utilizing a degradable member as a secondary fluid control device for actuating a shifting sleeve. The embodiment of FIG. 22 has a top connection 1022, ported housing 1024 with ports 1026, inner sleeve 1010, shifting sleeve 1046, bottom connection 1055 and shear pin 1063 generally according to the arrangement described with respect to the embodiment of FIGS. 9 and 10C above. The primary fluid path for applying fluid pressure to the shifting sleeve 1046 comprises an inlet port, inlet groove (each not shown) and inlet mandrel passageway 1007, thus allowing the shifting sleeve to move from a first position to a second position in response fluid pressure received from outside the embodiment downhole tool via flow tubing or other fluid source. In certain embodiments Outlet mandrel passageway 1017 allows fluid to exit the outlet pressure chamber once the shifting sleeve 1046 is moved to the open position. It will be appreciated that a secondary fluid control devices may be used with embodiments having a receiving chamber, e.g. that do not have an outlet conduit, and with device that do not have an inlet chamber, including, but not limited to, the embodiment of FIG. 1.

Degradable member 1033 is disposed in an inner sleeve passage 1030 preventing fluid flow from the interior flowpath to the end of shifting sleeve 1046. In normal operation, degradable member 1033 remains intact and fluid does not flow through the inner sleeve passage 1030. It will be appreciated that the degradable member 1033 may be a threaded member such as a plug, screw, or similar element. However, if the shifting sleeve fails to move to the second position as desired, the degrading element may be exposed to an appropriate liquid in order to open the inner sleeve passage 1030. For example, coil tubing may extend from the wellhead to place straddle packers on either side of the downhole tool. Acid or other suitable solvent could be introduced to the downhole tool to degrade the degradable member 1033 and pressure applied to the downhole tool to open the sleeve. Further, because of the presence of the straddle packers, the formation adjacent to the downhole tool may selectively fractured or otherwise treated through the coil tubing once the shifting sleeve is open.

The degradable member may be used as a timer during which the tubing string may be pressure tested up to the pressure rating of the seal containing a degradable member. While the degradation is occurring, pressure can be applied to a tubing string in which the downhole tool is installed to test the integrity of the tubing installation. When the degradation has progressed sufficiently to allow pressure to the upper pressure chamber, the shifting sleeve opens to create communication between the interior flowpath and the exterior of the tool. For degradable members comprising material that degrade at the ambient well temperature, the timer essentially starts upon installation of the downhole tool into the well. Such materials are known in the art and certain materials are described in U.S. Patent Publication No. 20120181032, filed by Naedler et al on Jan. 13, 2012, the descriptions of said materials being incorporated by reference herein. Other suitable materials are currently known in the art. Assemblies that comprise either of or both a material that degrades in response to the ambient well temperature and a second material not degradable solely in response to the ambient well temperature are also envisioned.

The degradable member may be matched to its environment and the fluid to which it is exposed in order to speed up or slow down the degradation process, e.g. to set the timer. Rupturing of the burst disk starts the timer by initiating the degradation process. For example, a magnesium rod degradation member may be thicker to increase the time needed for degradation sufficient to open the fluid path to occur. Further, the solvent strength, such as the concentration of hydrochloric acid, may be adjusted to increase or decrease the rate of degradation as desired. This allows for estimation or selection of the minimum and maximum times required before the degradable member allows fluid to flow from the longitudinal passage 954 to the upper pressure chamber, thereby moving the shifting sleeve from the first position to the second position. In addition, the degradable member may be part of an assembly comprising multiple parts such as threaded elements, seals, gaskets or other members provided that the assembly prevents fluid flow through a fluid path until the degradable member is exposed to a fluid The downhole tool may be placed in positions other than the toe of the tubing, provided that sufficient interior flowpath pressure can be applied at a desired point in time to create the necessary pressure differential on the shifting sleeve. In certain embodiments, the interior flowpath pressure must be sufficient to rupture the burst disk, shear the shear pin, or otherwise overcome a pressure sensitive control element. However, other control devices not responsive to pressure may be desirable for the present device when not installed in the toe.

The downhole tool as described may be adapted to activate tools associated with the tubing rather than to open a flow path from the interior to the exterior of the tubing. Such associated tools may include a mechanical or electrical device which signals or otherwise indicates that the burst disk or other flow control device has been breached. Such a device may be useful to indicate the pressures a tubing string experiences at a particular point or points along its length. In other embodiments, the device may, when activated, trigger release of one section of tubing from the adjacent section of tubing or tool. For example, the shifting element may be configured to mechanically release a latch holding two sections of tubing together. Any other tool may be used in conjunction with, or as part of, the tool of the present disclosure provided that the inner member selectively moves within the space in response to fluid flow through the flowpath 830. Numerous such alternate uses will be readily apparent to those who design and use tools for oil and gas wells.

It will be appreciated that the term "degrade" as used herein, as well as its various grammatical forms, is intended to have a broad meaning encompassing melting, dissolution, chemical alteration, corrosion, or other change to a degrading element of embodiments of the present disclosure. Such changes will be based, at least in part, on temperature or on the characteristics of fluid to which the degrading member is exposed, other than the fluid pressure. Further, while fluid pressure may, and in certain cases will, effect or accelerate the failure of a degrading member, such member will typically experience melting, dissolution, chemical alteration, corrosion or similar effect as a precursor to such failure.

Still further, while embodiment degradable members include balls, plugs, disks and rods, other degradable members are possible.

The illustrative embodiments are described with the shifting sleeve's first position being "upwell" or closer to the wellhead in relation to the shifting sleeve's second position, the downhole tool could readily be rotated such that the shifting sleeve's first position is "downwell" or further from the wellhead in relation to the shifting sleeve's second position. In addition, the illustrative embodiments provide possible locations for the flow path, fluid control device, shear pin, inner member, and other structures, those or ordinary skill in the art will appreciate that the components of the embodiments, when present, may be placed at any operable location in the downhole tool.

The present disclosure includes preferred or illustrative embodiments in which specific tools are described. Alternative embodiments of such tools can be used in carrying out the invention as claimed and such alternative embodiments are limited only by the claims themselves. Other aspects and advantages of the present invention may be obtained from a study of this disclosure and the drawings, along with the appended claims.

We claim:

1. A downhole a tool having an interior flowpath and an exterior comprising:

an inner sleeve;

a housing positioned outwardly of said inner sleeve, said housing and said inner sleeve partially defining a first space and a second space therebetween the first space and the second space in fluid isolation from the interior flowpath, from the exterior and from each other;

a shifting sleeve occupying a portion of said first space and a portion of said second space;

said housing further comprising a passageway for fluid communication from the interior flowpath of the housing to said space adjacent a first end of said shifting sleeve;

a fluid control device within said passageway, said fluid control device comprising a degradable member; and wherein said shifting sleeve is selectively moveable from a first position to a second position, thereby moving the first end away from the passageway, in response to a predetermined fluid pressure in said passageway after at least partial degradation of said degradable member.

2. The downhole tool of claim 1 further comprising an input connector disposed on said housing, said input connector defining an opening to the passageway that enables fluid communication from the exterior of the housing to said first space.

3. The downhole tool of claim 2 wherein said fluid control device is disposed in a wall of said inner sleeve.

4. The downhole tool of claim 1 wherein said fluid control device is disposed in an inlet pressure chamber.

5. The downhole tool of claim 1 wherein said fluid control device is disposed in an upper pressure chamber.

6. The downhole tool of claim 1 further comprising a burst disk preventing fluid communication between the interior flowpath and the fluid control device.

7. A method for treating a well for oil, gas, or other hydrocarbons, said well containing a device having an interior flowpath and an exterior, the device comprising:

an outer housing, said housing having at least one port therethrough;

at least one shifting sleeve mounted within the housing, said shifting sleeve having a first position and a second position;

a first pressure chamber in fluid communication with said at least one shifting sleeve and a second pressure chamber in fluid communication with said at least one shifting sleeve, the first pressure chamber and the second pressure chamber in fluid isolation from the exterior, from the interior flowpath, and from each other;

a first fluid control device having a closed state and an open state, the first fluid control device preventing fluid communication between the pressure chamber and the interior flowpath when the first fluid control device is in the closed state and permitting fluid communication between the interior flowpath and the pressure chamber in the open state;

a second fluid control device having a closed state and an open state, the second fluid control device preventing fluid communication between the pressure chamber and the interior flowpath when the second fluid control device is in the closed state and permitting fluid communication between the interior flowpath and the pressure chamber in the open state;

wherein, the interior flowpath is not in fluid communication with the exterior when the shifting sleeve is in the first position, and the interior flowpath is in fluid communication with the exterior when the shifting sleeve is in the second position; and the shifting sleeve is moveable from the first position to the second position in response to a predetermined interior flowpath pressure that is greater than the pressure chamber pressure; and changing the first fluid control device from a closed state to an open state;

changing the second fluid control device from a closed state to an open state to allow fluid pressure from the interior flowpath to move the shifting sleeve from the first position to the second position.

8. The method of claim 7 wherein the first fluid control device comprises a burst disk and the second fluid control device comprises a degradable member, the method comprising rupturing the burst disk with hydraulic pressure from said interior flowpath, and degrading the degradable member in response to exposure to a selected fluid.

9. The method of claim 7 wherein the degradable member is exposed to the selected fluid after the first fluid control member is changed to an open state.

10. The method of claim 9 wherein the first fluid control member is a burst disk.

11. The method of claim 7 wherein at least one of the first fluid control device and second fluid control device are comprised of a magnesium alloy as the degradable material.

12. A method of preparing an open hole well for treating in at least one petroleum production zone formation in which a tubing string is inserted into the open hole well and cement is pumped through the production tubing into the open hole well, the method comprising: as the production tubing is inserted into the open hole well, providing at least one sliding valve to be positioned at a predetermined location along the production tubing;

said at least one sliding valve comprising an enclosure at least partially defining an interior flowpath of the sliding valve, the enclosure comprising an enclosure flowpath with a fluid control device comprising a degradable member therein; the enclosure comprising a first chamber and a second chamber in fluid isolation from each other, from the open hole and from the interior flowpath; at least one shifting member mounted within enclosure, the enclosure preventing fluid communication from the interior flowpath of the tubing to a first surface of the shifting member in the first chamber;

closing the end of the tubing string;

pressure testing the tubing string in the open hole well; then changing the fluid control device from a closed state to an open state by degradation of the degradable member, thereby creating fluid communication between the interior flowpath and the first surface of the shifting member;

moving the shifting member from a closed position to an open position; and flowing fluid from the interior of the sliding valve to the exterior of the sliding valve.

13. The method of claim 12 wherein the shifting member is moved from the closed position to the open position by application of fluid pressure against the first surface of the shifting member.

14. The method of claim 12 wherein the at least one sliding valve further comprises a burst disk, the method further comprising rupturing the burst disk by application of fluid pressure thereto.

15. The method of claim 14 wherein the burst disk isolates the fluid control device from fluid in the interior flowpath of the sliding valve.

16. The method of claim 12 wherein the fluid control device isolates the burst disk from fluid in the interior flowpath of the sliding valve.

* * * * *